US006273359B1

(12) United States Patent
Newman et al.

(10) Patent No.: US 6,273,359 B1
(45) **Date of Patent: *Aug. 14, 2001**

(54) DISPENSING SYSTEM AND METHOD FOR PREMOISTENED WIPES

(75) Inventors: William R. Newman; Herb F. Velazquez, both of Neenah, WI (US); Cherry A. Bochmann, Cleveland; Jerry P. DeGreen, Windsor, both of OH (US)

(73) Assignee: Kimberly-Clark Worldwide, Inc., Neenah, WI (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/302,281

(22) Filed: Apr. 30, 1999

(51) Int. Cl.[7] ..... B65H 16/02; B65H 23/04

(52) U.S. Cl. ..... 242/595; 242/594.1; 242/615.2; 242/615.4; 221/303

(58) Field of Search ..... 242/595, 594.1, 242/615.2, 615.4, 588.3; 206/409; 221/303

(56) References Cited

U.S. PATENT DOCUMENTS

| | | |
|---|---|---|
| Re. 35,976 | 12/1998 | Gasparrini et al. . |
| D. 303,890 | 10/1989 | Pilot . |
| D. 311,106 | 10/1990 | Jaber . |

(List continued on next page.)

FOREIGN PATENT DOCUMENTS

| | | |
|---|---|---|
| 0 122 809 A1 | 10/1984 | (EP) . |
| 0 501 905 A1 | 9/1992 | (EP) . |
| WO 96/21388 | 7/1996 | (WO) . |
| WO 98/08763 A1 | 3/1998 | (WO) . |
| WO 99/01536 A1 | 1/1999 | (WO) . |
| WO 99/06311 A2 | 2/1999 | (WO) . |

OTHER PUBLICATIONS

Derwent World Patent Database abstract of DE 3133237: Description of M. Scheepe, "Refill Pack of Moisture–Impregnated Tissues."

Derwent World Patent Database abstract of JP 07–284,461 A: Description of Kusunoki N (KUSU–1), "Toilet Paper Holder," and Patent Abstracts of Japan JP 07–284,461: Description of Kusunoki Nobuaki, "Toilet Paper–Holder Allowing Taking Out Paper Thereof With One Hand."

(List continued on next page.)

*Primary Examiner*—John Q. Nguyen
(74) *Attorney, Agent, or Firm*—Michael J. Bendel

(57) ABSTRACT

A dispensing system and method for premoistened wipes. The dispensing system includes first and second longitudinally extending dispensing guides. The first guide is positioned substantially parallel and in proximity to the second guide to define a gap. The dispensing guides may each be rotatable about a longitudinally extending axis and comprise cylinders having a plurality of lands and grooves. The wipes are dispensed by passage through the gap and a dispensing opening having an edge which is defined in part by an impingement surface. The impingement surface has a first outer portion, a second outer portion and a central portion positioned between the two outer portions. The impingement surface is configured whereby the outer portions of the impingement surface more forcibly engage the wipe into engagement with the dispensing guides than the central portion of the impingement surface. This helps to maintain the wipes in a substantially flat condition as they are dispensed and prevents the "bunching up" of the wipe. The dispensing of the wipes with such a system may involve engaging a wipe with the impingement surface where outer portions of the impingement surface extend a greater distance than the central portion in a direction impinging on the wipe. The two outer portions of the impingement surface engage the wipe in areas adjacent opposite side edges of the wipe.

30 Claims, 22 Drawing Sheets

U.S. PATENT DOCUMENTS

D. 329,978 10/1992 Ryan .
D. 342,635 12/1993 Carter et al. .
D. 342,852 1/1994 Welch .
D. 347,534 6/1994 Gottselig .
D. 362,773 10/1995 Kartchner .
D. 377,284 1/1997 Farrow et al. .
D. 381,851 8/1997 Sharpe .
D. 386,025 11/1997 Mervar et al. .
D. 387,590 12/1997 Cameron et al. .
D. 397,265 8/1998 Badillo .
D. 412,439 8/1999 Cormack .
D. 416,794 11/1999 Cormack .
D. 417,109 11/1999 Johnson et al. .
D. 417,987 12/1999 Velazquez .
D. 421,691 3/2000 Hoblitz .
D. 422,437 4/2000 Conran et al. .
1,664,392 4/1928 Baruch .
2,440,974 5/1948 Resch .
3,310,353 3/1967 Cordis .
3,368,522 2/1968 Cordis .
3,532,210 10/1970 Minion et al. .
3,568,635 3/1971 Poitras et al. .
3,592,161 7/1971 Hoffmann .
3,633,838 1/1972 Krueger .
3,656,699 4/1972 Schnyder et al. .
3,713,170 1/1973 Kaufman .
3,729,145 4/1973 Koo et al. .
3,754,804 8/1973 Cushman .
3,756,483 9/1973 Schraeder .
3,771,739 11/1973 Nelson .
3,775,801 12/1973 Walker .
3,780,908 12/1973 Fitzpatrick et al. .
3,784,055 1/1974 Anderson .
3,788,573 1/1974 Thomson et al. .
3,795,355 3/1974 Gerstein .
3,806,055 4/1974 Bauman .
3,824,953 7/1974 Boone .
3,836,044 9/1974 Tilp et al. .
3,836,045 9/1974 Duhy et al. .
3,837,595 * 9/1974 Boone ..... 242/595 X
3,841,466 10/1974 Hoffman et al. .
3,843,017 10/1974 Harrison .
3,848,822 11/1974 Boone .
3,865,271 2/1975 Gold .
3,890,622 6/1975 Alden .
3,913,522 10/1975 Light .
3,949,947 4/1976 Youngquist et al. .
3,967,756 7/1976 Barish .
3,970,215 7/1976 McLaren et al. .
3,982,659 9/1976 Ross .
3,986,479 10/1976 Bonk .
3,994,417 11/1976 Boedecker .
3,995,582 12/1976 Douglas .
4,002,264 1/1977 Marchesani .
4,004,687 1/1977 Boone .
4,025,004 5/1977 Massey .
4,043,519 8/1977 Suzuki et al. .
4,069,789 1/1978 Fukagawa et al. .
4,071,200 1/1978 Stone .
4,098,469 7/1978 McCarthy .
4,101,026 7/1978 Bonk .
4,106,433 8/1978 Fernando et al. .
4,106,616 8/1978 Boone .
4,106,617 8/1978 Boone .
4,114,824 9/1978 Danielak .
4,124,259 11/1978 Harris .
4,131,195 12/1978 Worrell, Sr. .
4,135,199 1/1979 Kurland et al. .
4,135,678 1/1979 Williams .
4,138,034 2/1979 McCarthy .
4,179,078 12/1979 Mansfield .
4,191,317 3/1980 Harkins .
4,205,802 6/1980 Economakis .
4,219,129 8/1980 Sedgwick .
4,222,621 9/1980 Greenlee et al. .
4,235,333 11/1980 Boone .
4,244,493 1/1981 Harrison .
4,260,117 4/1981 Perrin et al. .
4,274,573 6/1981 Finkelstein .
4,294,389 10/1981 Falk et al. .
4,328,907 5/1982 Beard .
4,353,480 10/1982 McFadyen .
4,363,454 12/1982 Mohar .
4,375,874 3/1983 Leotta et al. .
4,383,656 5/1983 Campbell .
4,401,248 8/1983 Helms .
4,411,374 10/1983 Hotchkiss .
4,425,012 1/1984 Kley .
4,427,159 1/1984 Miller et al. .
4,428,497 1/1984 Julius et al. .
4,432,504 2/1984 Pace .
4,436,221 3/1984 Margulies .
4,447,015 5/1984 Peterson .
4,453,634 6/1984 Blumenthal .
4,463,912 8/1984 Grunerud .
4,467,974 8/1984 Crim .
4,526,291 7/1985 Margulies .
4,535,912 8/1985 Bonk .
4,550,855 11/1985 Harrison .
4,564,148 1/1986 Wentworth .
4,566,606 1/1986 Kling .
4,570,820 2/1986 Murphy .
4,607,809 8/1986 Sineni et al. .
4,648,530 3/1987 Granger .
4,659,028 4/1987 Wren .
4,662,576 5/1987 Paul .
4,662,577 5/1987 Lewis .
4,684,075 8/1987 Francis .
4,690,345 9/1987 Cotey .
4,721,264 1/1988 Muscarello .
4,735,317 4/1988 Sussman et al. .
4,756,485 7/1988 Bastian et al. .
4,784,290 11/1988 Howard .
4,790,490 12/1988 Chakravorty .
4,807,823 2/1989 Wyant .
4,826,063 5/1989 Ban .
4,830,301 5/1989 Miller .
4,834,316 5/1989 DeLorean .
4,836,368 6/1989 Cotton .
4,836,462 6/1989 Bruss .
4,846,412 7/1989 Morand .
4,860,893 8/1989 Kaufman .
4,877,133 10/1989 Klenter et al. .
4,883,197 11/1989 Sanchez et al. .
4,884,690 12/1989 Klenter et al. .
4,890,205 12/1989 Shaffer .
4,913,365 4/1990 Shamass .
4,936,452 6/1990 Pauley .
4,978,095 12/1990 Phillips .
4,984,530 1/1991 Dutton .
4,989,800 2/1991 Tritch .
4,991,538 2/1991 Davids et al. .
5,000,393 3/1991 Madsen .
5,009,313 4/1991 Morand .
5,012,986 5/1991 Needle .
5,029,787 7/1991 Florentin .
5,050,737 9/1991 Joslyn et al. .
5,104,054 4/1992 Latham .
5,137,173 8/1992 Hughes et al. .
5,141,171 8/1992 Yang .
5,145,091 9/1992 Meyers .

| | | |
|---|---|---|
| 5,154,496 | 10/1992 | Campbell et al. . |
| 5,170,958 | 12/1992 | Brown . |
| 5,172,840 | 12/1992 | Bloch et al. . |
| 5,192,044 | 3/1993 | Baskin . |
| 5,193,759 | 3/1993 | Bigelow et al. . |
| 5,195,689 | 3/1993 | Beer et al. . |
| 5,207,367 | 5/1993 | Dunn et al. . |
| 5,219,092 | 6/1993 | Morand . |
| 5,228,632 | 7/1993 | Addison et al. . |
| 5,253,818 | 10/1993 | Craddock . |
| 5,255,800 | 10/1993 | Kelly . |
| 5,277,375 | 1/1994 | Dearwester . |
| 5,310,262 | 5/1994 | Robison et al. . |
| 5,311,986 | 5/1994 | Putz . |
| 5,335,811 | 8/1994 | Morand . |
| 5,368,157 | 11/1994 | Gasparrini et al. . |
| 5,370,336 | 12/1994 | Whittington . |
| 5,374,008 | 12/1994 | Halvorson et al. . |
| 5,392,945 | 2/1995 | Syrek . |
| 5,400,982 | 3/1995 | Collins . |
| 5,409,181 | 4/1995 | Patrick . |
| 5,439,521 | 8/1995 | Rao . |
| 5,443,084 | 8/1995 | Saleur . |
| 5,449,127 | 9/1995 | Davis . |
| 5,456,420 | 10/1995 | Frazier . |
| 5,456,421 | 10/1995 | Reed . |
| 5,464,170 | 11/1995 | Mitchell et al. . |
| 5,480,060 | 1/1996 | Blythe . |
| 5,494,250 | 2/1996 | Chen . |
| 5,495,997 | 3/1996 | Moody . |
| 5,509,593 | 4/1996 | Bloch et al. . |
| 5,526,973 | 6/1996 | Boone et al. . |
| 5,533,621 | 7/1996 | Schoal, Jr. . |
| 5,542,568 | 8/1996 | Julius . |
| 5,560,514 | 10/1996 | Frazier . |
| 5,588,615 | 12/1996 | Batts . |
| 5,598,987 | 2/1997 | Wachowicz . |
| 5,604,992 | 2/1997 | Robinson . |
| 5,605,250 | 2/1997 | Meiron et al. . |
| 5,618,008 | 4/1997 | Dearwester et al. . |
| 5,624,025 | 4/1997 | Hixon . |
| 5,630,526 | 5/1997 | Moody . |
| 5,630,563 | 5/1997 | Meisner et al. . |
| 5,642,810 | 7/1997 | Warner et al. . |
| 5,649,676 | 7/1997 | Lord . |
| 5,653,403 | 8/1997 | Ritchey . |
| 5,655,661 | 8/1997 | Rigby . |
| 5,660,313 | 8/1997 | Newbold . |
| 5,660,636 | 8/1997 | Shangold et al. . |
| 5,667,092 | 9/1997 | Julius et al. . |
| 5,669,576 | 9/1997 | Moody . |
| 5,672,206 | 9/1997 | Gorman . |
| 5,687,875 | 11/1997 | Watts et al. . |
| 5,697,576 | 12/1997 | Bloch et al. . |
| 5,697,577 | 12/1997 | Ogden . |
| 5,704,565 | 1/1998 | Cheng . |
| 5,704,566 | 1/1998 | Schutz et al. . |
| 5,765,717 | 6/1998 | Gottselig . |
| 5,848,275 | 2/1999 | Moody . |
| 5,848,762 | 12/1998 | Reinheimer et al. . |
| 5,868,335 | 2/1999 | Lebrun . |
| 5,868,344 | 2/1999 | Melnick . |
| 5,868,345 | 2/1999 | Beisser . |
| 5,868,346 | 2/1999 | Cobos . |
| 5,868,347 | 2/1999 | Paul et al. . |
| 5,887,759 | 3/1999 | Ayigbe . |
| 5,887,818 | 3/1999 | Kelley . |
| 5,893,531 | 4/1999 | Taylor et al. . |
| 5,897,074 | 4/1999 | Mariono . |
| 5,901,921 | 5/1999 | Perlsweig . |
| 5,904,316 | 5/1999 | Dunning et al. . |
| 5,924,617 | 7/1999 | LaCount et al. . |
| 5,938,013 | 8/1999 | Palumbo et al. . |
| 5,950,960 | 9/1999 | Marino . |
| 5,951,762 | 9/1999 | Shangold et al. . |
| 5,967,452 | 10/1999 | Wilder . |
| 5,971,138 | 10/1999 | Soughan . |
| 5,971,142 | 10/1999 | Jones . |
| 5,979,821 | 11/1999 | LaCount et al. . |
| 6,000,538 | 12/1999 | Lee . |
| 6,000,658 | 12/1999 | McCall, Jr. . |
| 6,007,019 | 12/1999 | Lynch . |
| 6,015,125 | 1/2000 | Fischer . |
| 6,024,323 | 2/2000 | Palermo, Jr. . |
| 6,036,134 | 3/2000 | Moody . |
| 6,047,920 | 4/2000 | Dearwester et al. . |
| 6,056,233 | 5/2000 | Von Schenk . |
| 6,056,235 | 5/2000 | Brozinsky . |
| 6,059,882 | 5/2000 | Steinhardt et al. . |
| 6,068,118 | 5/2000 | Calloway . |
| 6,079,603 | 6/2000 | Smegal . |
| 6,085,899 | 7/2000 | Thorsbakken . |
| 6,092,690 | 7/2000 | Bitowft et al. . |
| 6,092,758 | 7/2000 | Gemmell . |
| 6,092,759 | 7/2000 | Gemmell et al. . |
| 6,098,836 | 8/2000 | Gottselig . |

OTHER PUBLICATIONS

Derwent World Patent Database abstract of JP 00–085,782 A: Description of Pigeon KK (PIGE–N), "Paper Holder For Wet Tissues Used In Toilets," and Patent Abstracts of Japan JP 00–085,782: Description of Watanabe Kuniko et al., "Paper Holder."

Kotler, Philip, *Marketing Management*, Prentice Hall, Upper Saddle River, NJ, 2000, pp. 456–483.

Images of Moist Mates product—dispenser and wipes, Copyright 1996, 15 pages.

Images of Moist Mates product—dispenser, Copyright 2000, 13 pages.

Images of Moist Mates—refill wipes, Copyright 2000, 11 pages.

* cited by examiner

DISPENSING SYSTEM AND METHOD FOR PREMOISTENED WIPES

BACKGROUND OF THE INVENTION

The present invention relates to dispensing systems and methods, and, more specifically, to such dispensing systems and methods for use with premoistened wipes.

Premoistened wipes are well known in the art and a variety of different dispensers and dispensing methods have been developed for premoistened wipes. Such premoistened wipes are often provided in stacks placed in a refillable tub or similar container. Such containers may have a lid which can be opened to expose the stack of wipes or it may have an orifice through which the wipes are individually dispensed. When using a stack of wipes, the adjacent wipes of the stack are often interfolded.

When the premoistened wipes are stacked and dispensed through an orifice, the interfolding of the wipes can facilitate the partial dispensing of the following wipe through the orifice where it may be easily grasped for later dispensing. Rolls of premoistened wipes are also known in the art. Perforations are commonly used to facilitate the separation of individual wipes which are supplied in a roll. Rolled wipes are commonly dispensed through an orifice or opening of a container and may be dispensed from either the center or the outer circumference of the roll.

SUMMARY OF THE INVENTION

The present inventors have recognized difficulties and problems inherent in the prior art and in response thereto have developed an improved dispensing system and method for premoistened wipes.

In one aspect, the present invention provides a dispensing system for one or more premoistened wipes which comprises, i.e., includes but is not limited to, a first longitudinally extending dispensing guide and a second longitudinally extending dispensing guide which is positionable substantially parallel and in proximity to the first dispensing guide to thereby define a gap between the first and second dispensing guides. The premoistened wipes are dispensed by passage through the gap and a dispenser opening. The dispenser opening is defined along one edge by an impingement surface. The impingement surface has a first outer portion, a second outer portion and a central portion disposed between the first and second outer portions. The central portion of the impingement surface is disposed relative to the outer portions whereby a flat plane intersecting the gap and extending through the dispensing opening will contact the first and second outer portions prior to contacting the central portion when rotated about a line of intersection with the gap towards the impingement surface.

In some embodiments representing further aspects of such a dispenser system, the dispensing guides are each rotatable about a longitudinally extending axis and may comprise cylinders having a plurality of lands and grooves. The average longitudinal length of such lands and grooves may be greater adjacent the central portion than adjacent the outer portions. In other embodiments, the impingement surface may have a central portion which has a substantially curvilinear shape.

The dispenser system may also include a housing and a cover where the housing defines an interior space in which the premoistened wipes may be positioned. The cover has an open position which permits access to the interior space and a closed position wherein the first and second dispensing guides are positioned to form the gap when the cover is in the closed position. Such a cover may have one of the dispensing guides disposed thereon. The impingement surface may also be disposed on such a cover and may be formed by an edge of the cover. A removable tray may be positioned in such a dispenser and have the second dispensing guide disposed thereon. The dispensing guides disposed on the cover and removable tray may also each be rotatable about a longitudinally extending axis.

In another aspect, the present invention provides a dispensing system for premoistened wipes which includes a first longitudinally extending dispensing guide which is rotatable about a first longitudinal axis and a second longitudinally extending dispensing guide which is rotatable about a second longitudinal axis. The second dispensing guide is positionable substantially parallel and in proximity to the first dispensing guide to thereby define a gap between the first and second dispensing guides. The premoistened wipes are dispensed by passage through the gap and a dispenser opening. An impingement surface defines one edge of the dispensing opening. The impingement surface has a first outer portion, a second outer portion, and a central portion disposed between the outer portions. The central portion is disposed relative to the outer portions whereby the central portion and the outer portions of the impingement surface are disposed on opposite sides of a flat plane which intersects the gap and is oriented perpendicularly to a plane connecting the first and second dispenser guide axes and wherein the flat plane lies within the dispensing opening adjacent the central portion of the impingement surface.

In some embodiments representing further aspects of such a dispenser system, the dispensing guides are each rotatable about a longitudinally extending axis and may comprise cylinders having a plurality of lands and grooves. The average longitudinal length of such lands and grooves may be greater adjacent the central portion than the outer portions of the impingement surface. In other embodiments, the impingement surface may have a central portion which has a substantially curvilinear shape.

The dispenser system may also include a housing and a cover where the housing defines an interior space in which the premoistened wipes may be positioned. The cover has an open position which permits access to the interior space and a closed position wherein the first and second dispensing guides are positioned to form the gap when the cover is in the closed position. Such a cover may have one of the dispensing guides disposed thereon. The impingement surface may also be disposed on such a cover and may be formed by an edge of the cover. A removable tray may be positioned in such a dispenser and have the second dispensing guide disposed thereon. The dispensing guides disposed on the cover and removable tray may also each be rotatable about a longitudinally extending axis.

In yet another aspect, the present invention provides a method of dispensing premoistened wipes. The method includes providing a plurality of premoistened wipes, each of the wipes having a first side edge and a second side edge. The method also involves forming a gap between a first longitudinally extending dispensing guide and a second longitudinally extending dispensing guide. A leading wipe is placed in the gap in a substantially flat configuration whereby the first and second side edges of the leading wipe are disposed on opposite sides of the gap and a forward edge of the leading wipe extends through the gap where it may be grasped by a user. The leading wipe is engaged with an impingement surface and in an impingement direction. The impingement surface has a first outer portion, a second outer portion, and a central portion disposed between the first and second outer portions. The impingement surface is configured whereby the outer portions extend a greater distance than the central portion in a direction impinging on the leading wipe and whereby the first and second outer portions respectively engage the leading wipe in first and second areas proximate the first and second side edges.

Such a method may employ first and second dispensing guides which are rotatable. The rotatable dispensing guides may be cylinders having a plurality of lands and grooves wherein an average longitudinal length of the lands and grooves is greater adjacent the central portion than the outer portions of the impingement surface.

Alternative methods may include providing the plurality of premoistened wipes in housing having a cover wherein the cover has an open and closed position. The first dispensing guide may be disposed on the cover whereby the gap is formed by placing the cover in a closed position. The second dispensing guide may be disposed on a tray removeably positioned in the housing.

One advantage provided by the present invention is that it provides a convenient method for dispensing premoistened wipes provided in a rolled form. Furthermore, by using a coreless roll of premoistened wipes, the present invention provides a compact system for dispensing premoistened wipes.

Another advantage provided by that present invention is that it provides for the dispensing of premoistened wipes in a substantially uniform manner and inhibits the tendency of premoistened wipes to "bunch up" when being pulled through a gap. This prevents the damaging of the wipe or the jamming of the dispenser which might occur if the premoistened wipes were to "bunch up" when being dispensed through the gap.

These and other advantages of the invention are provided by its various aspects, individually and in combinations thereof.

BRIEF DESCRIPTION OF THE DRAWINGS

The invention will be more fully understood and further advantages will become apparent when reference is made to the following description of the invention and the accompanying drawings, in which.

Figure 1:
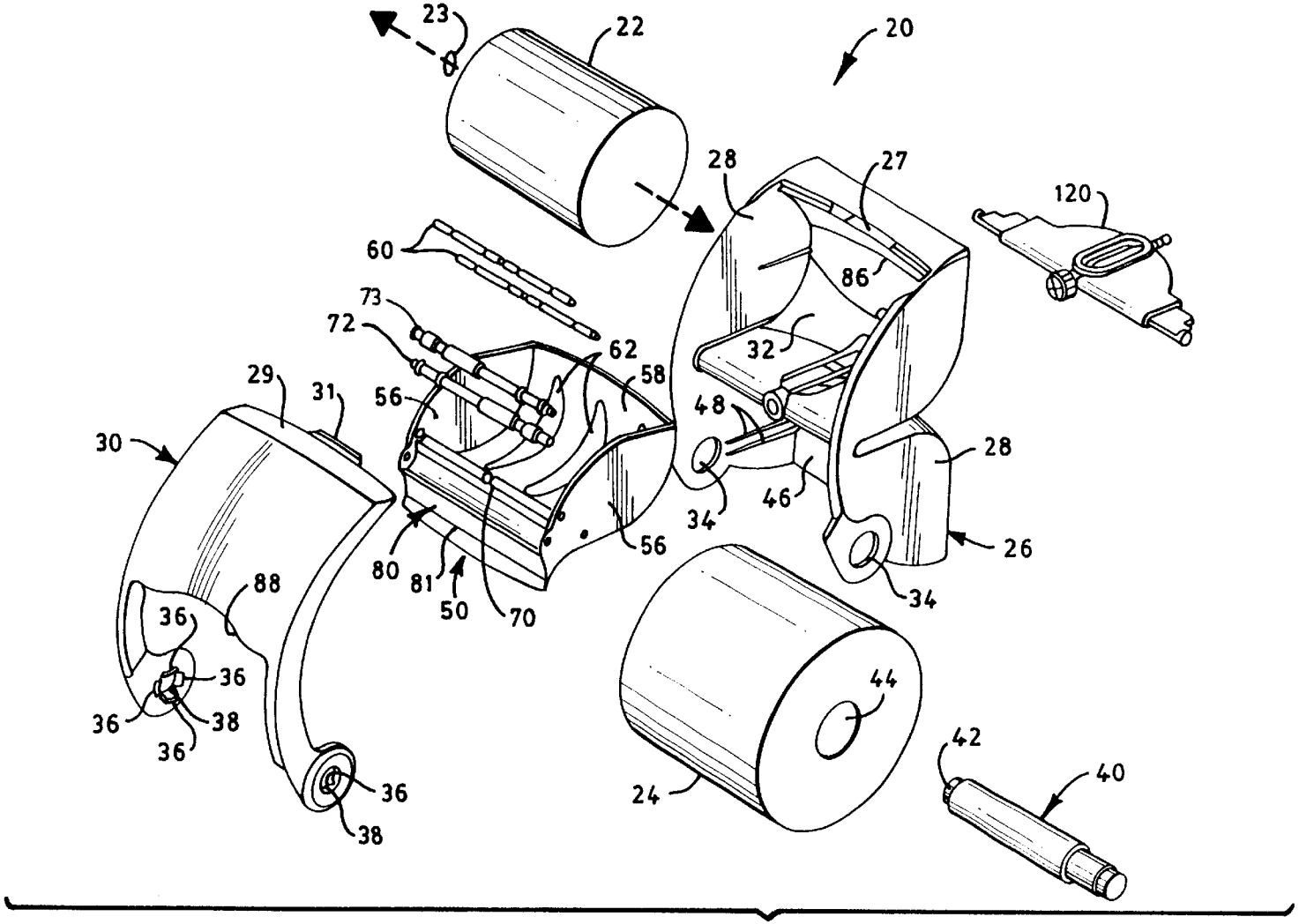
FIG. 1 is an exploded view of a dispenser in accordance with the present invention.

Corresponding reference characters indicate corresponding parts throughout the several views. The disclosed embodiments are set forth to illustrate and exemplify the invention. The disclosed embodiments are not intended to be an exhaustive illustration of the invention or to be construed as limiting the scope of the invention to the precise forms disclosed.

DESCRIPTION OF THE INVENTION

Figure 2:
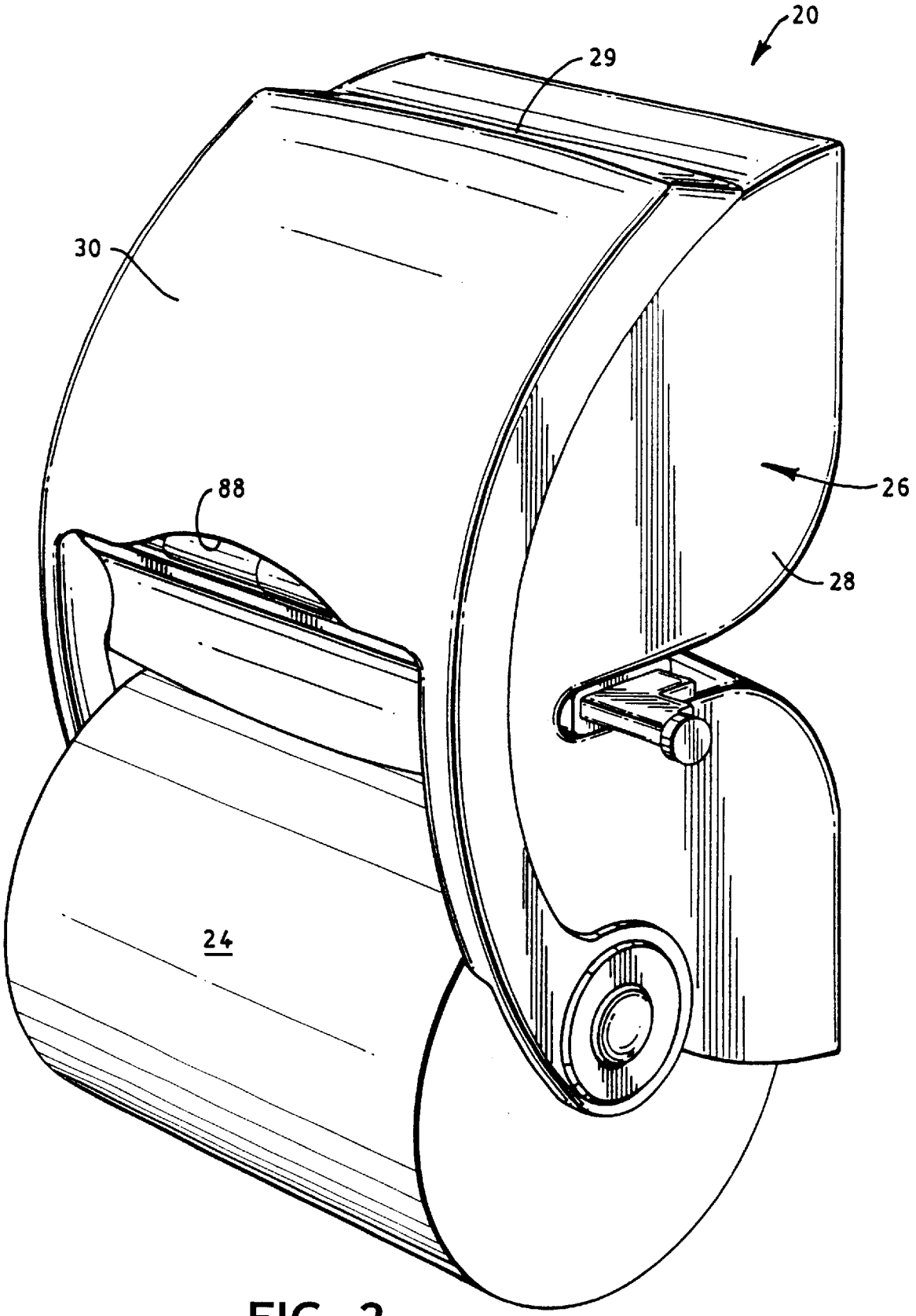
FIG. 2 is a perspective view of the dispenser of FIG. 1.
Figure 3:
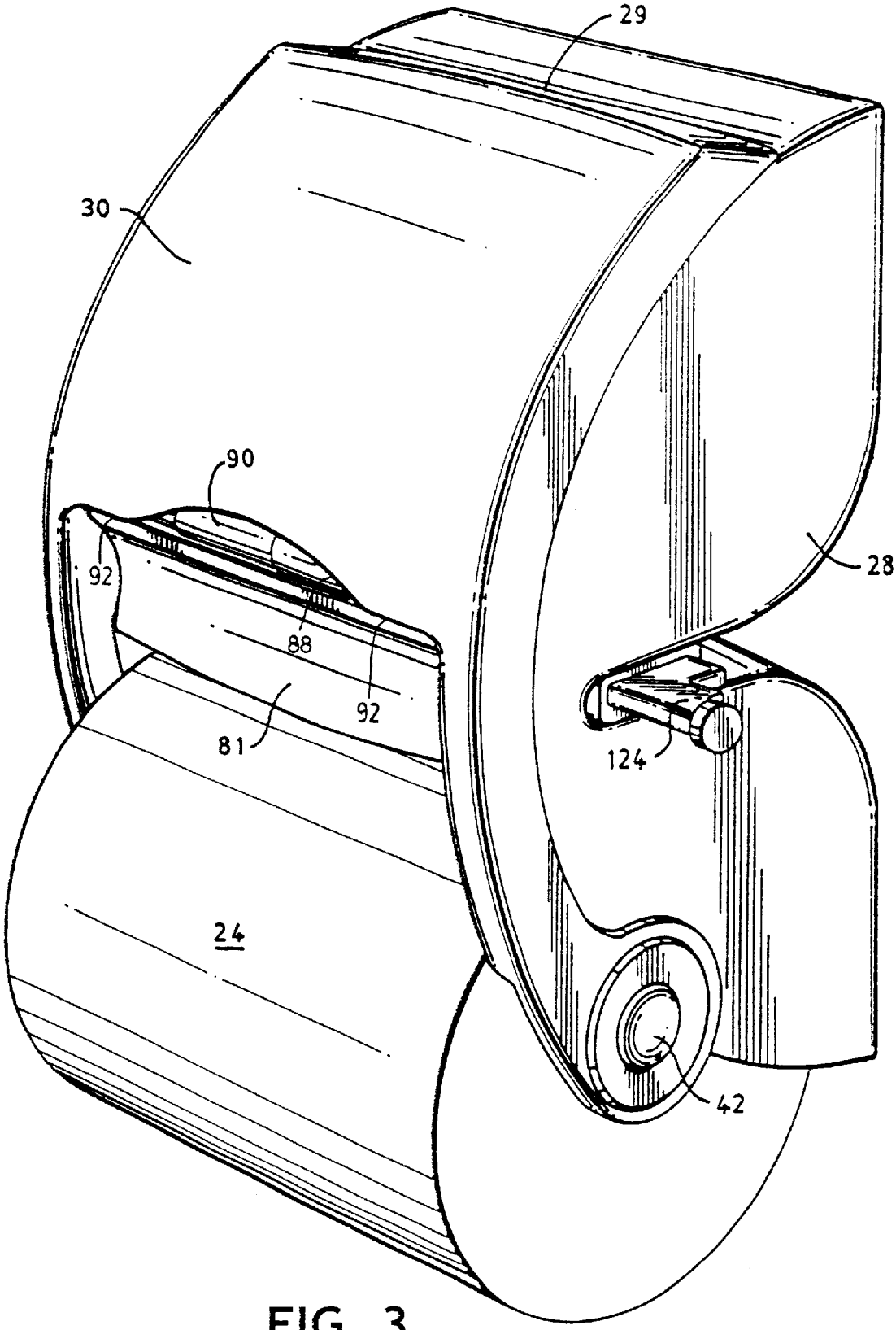
FIG. 3 is a perspective view of an alternative dispenser.
Figure 4:
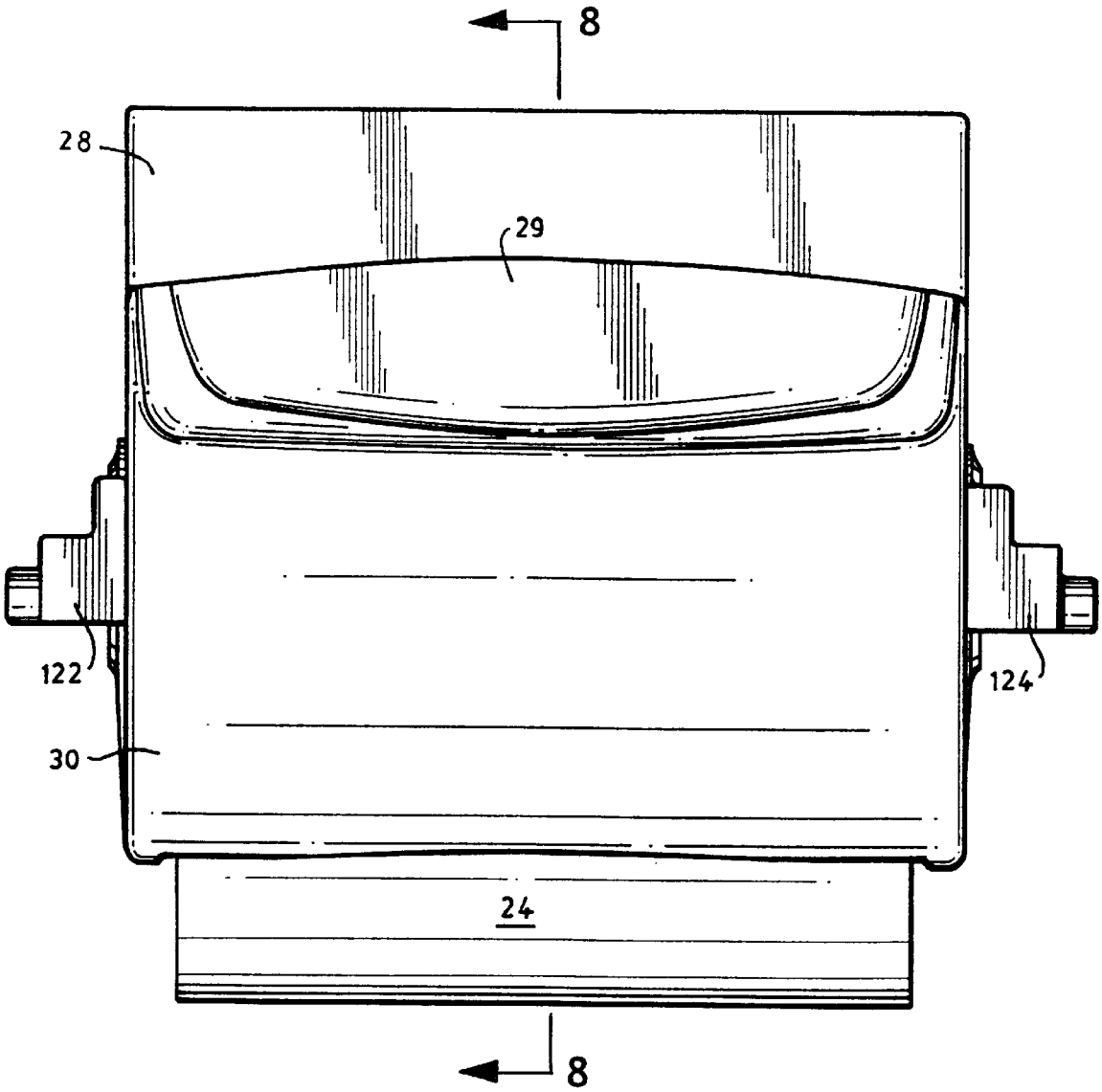
FIG. 4 is a top view of the dispenser of FIG. 3.
Figure 5:
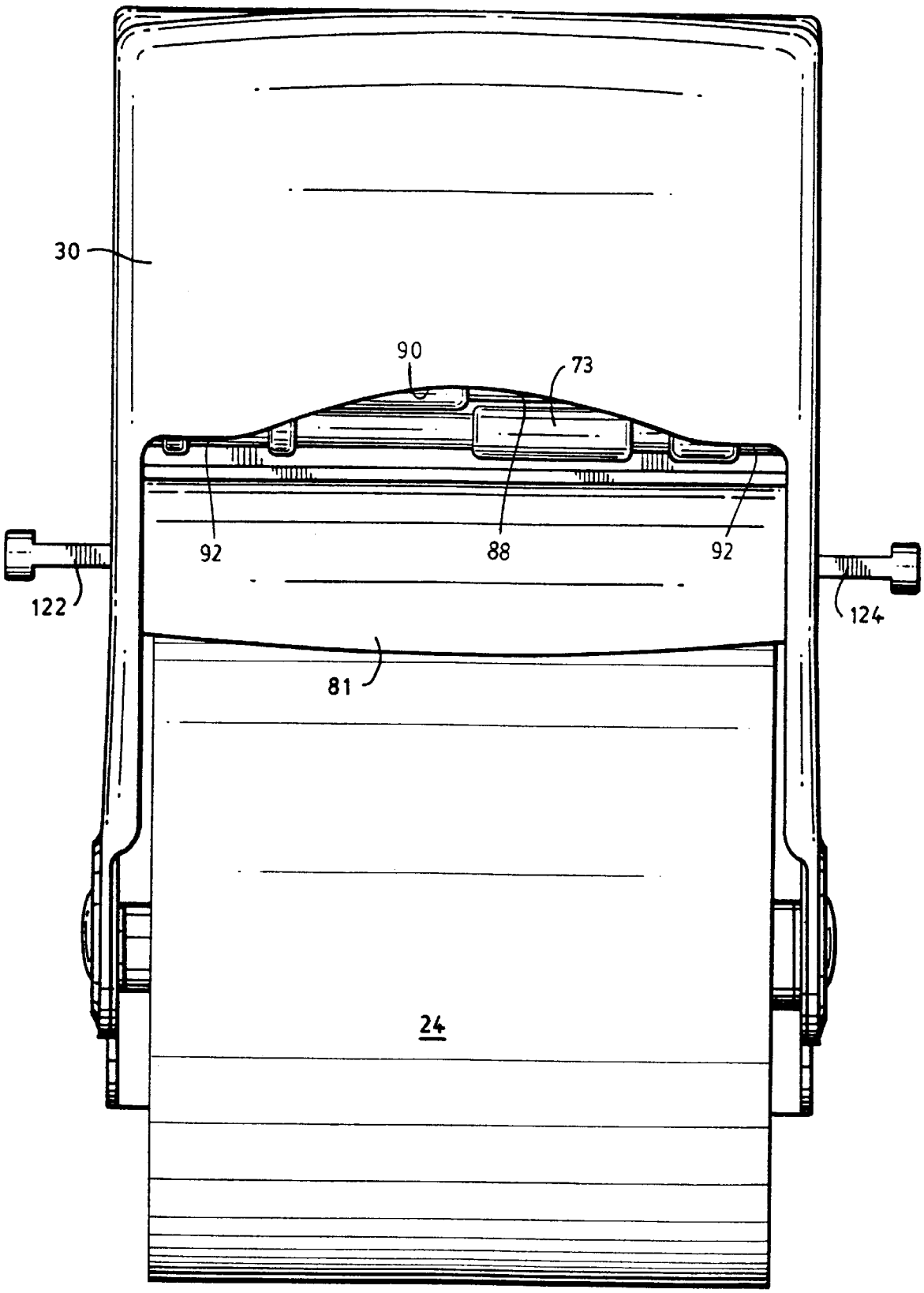
FIG. 5 is a front view of the dispenser of FIG. 3.
Figure 6:
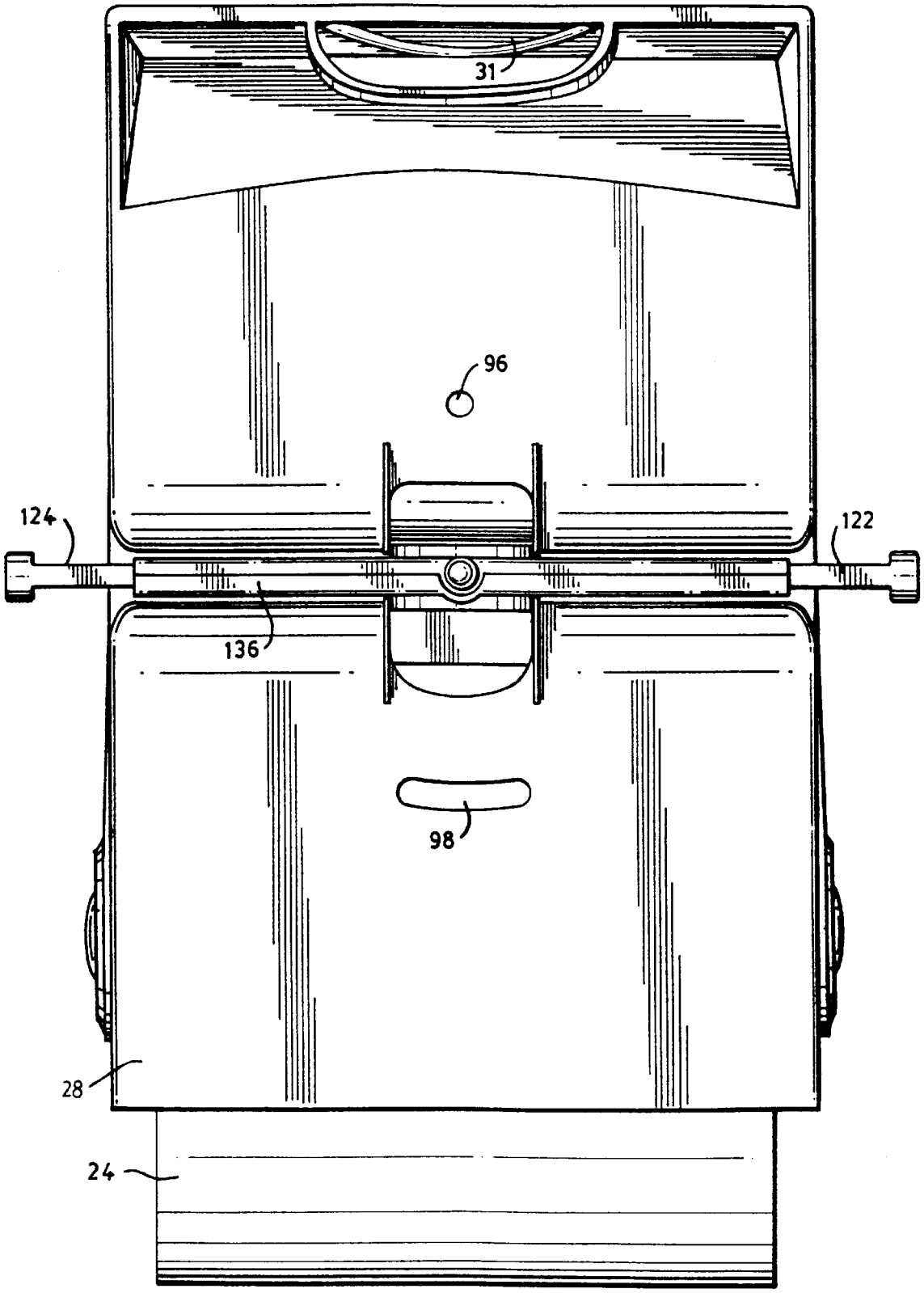
FIG. 6 is a rear view of the dispenser of FIG. 3.
Figure 7:
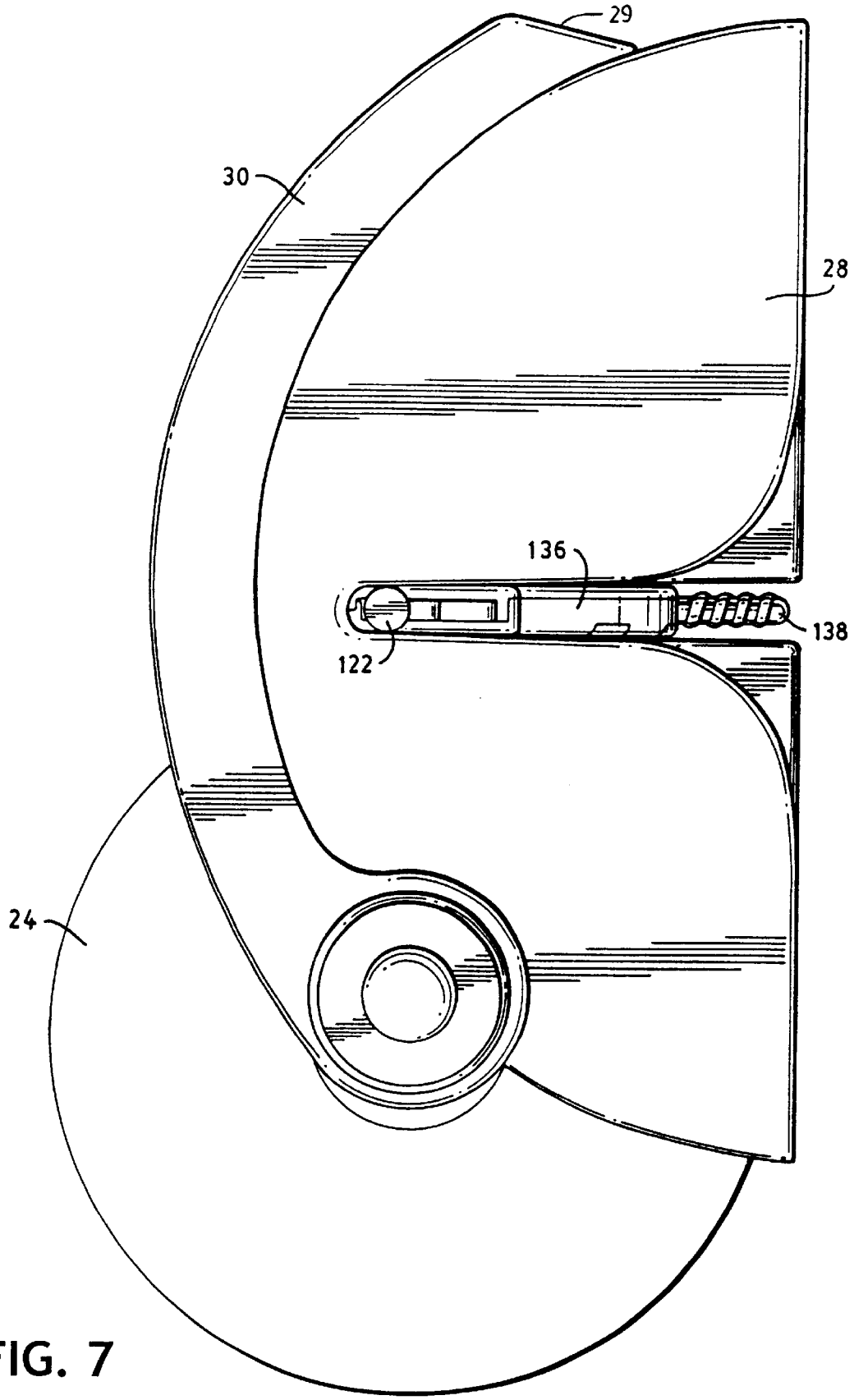
FIG. 7 is a side view of the dispenser of FIG. 3.
Figure 23:
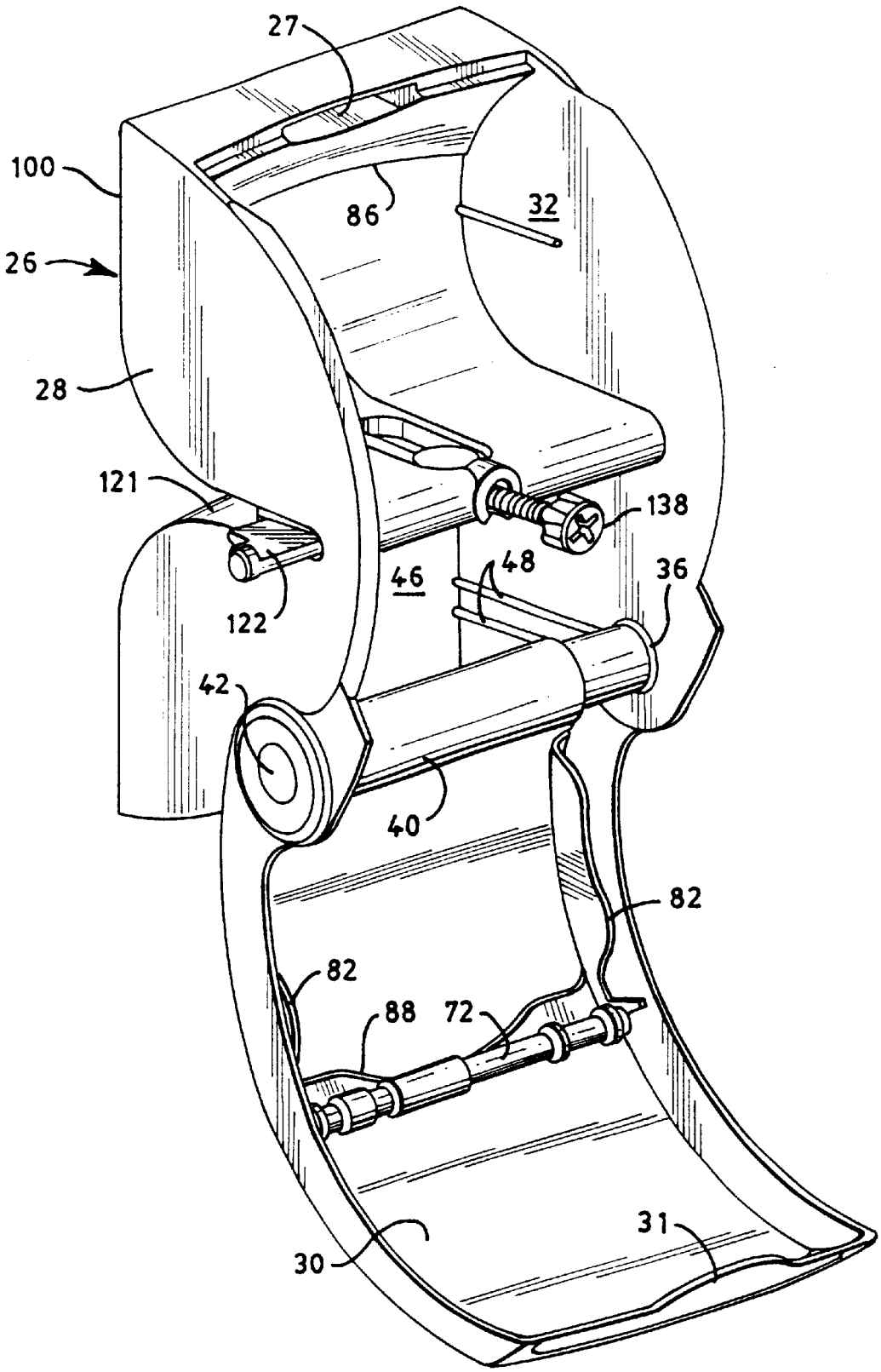
FIG. 23 is a perspective view of a dispenser housing and a mounting device.

FIG. 1 illustrates one representative embodiment of the present invention in an exploded view. As can be seen in FIG. 1, the illustrated dispenser 20 can be used to provide either or both premoistened wipes 22 and conventional dry bathroom tissues 24. The illustrated dispenser has a housing 26 with a frame 28 and a cover 30. Together the frame 28 and cover 30 enclose and define an interior space 32 when the cover is in a closed position as shown in FIG. 2. The cover 30 is shown in an open position in FIGS. 12 and 23.

The cover 30 is attached to the frame 28 at two circular apertures 34 in the frame 28. The cover 30 includes a plurality of projections 36 which are inserted inwardly through the apertures 34 to rotatably mount the cover 30 to the frame 28. The projections 36 provide a bearing surface for engagement with the interior surface of the apertures 34 whereby the cover 30 may be rotated between an open position and a closed position. Some or all of the projections 36 may include outwardly extending tangs at their distal ends which engage the inner surface of the frame 28 adjacent the apertures 34 and thereby inhibit the disengagement of the cover 30 and the frame 28.

The radially inward surfaces 38 of the projections 36 define an opening which is configured to receive the recessed end portions 42 of a telescoping roll bar 40. Telescoping roll bar 40 provides a support which is insertable into the hollow core 44 of a roll of dry bathroom tissue 24 in a conventional manner. The illustrated roll bar 40 has a female member which extends for approximately ¾ of the total length of the support to prevent the bar from tilting. The male and female members of the roll bar 40 remain assembled when removed from the dispenser 20 and include an internal spring selected to have a force which does not distort the housing frame 28. The ends of the roll bar 40 define a curved surface to provide an outward button-like appearance to the ends of the roll bar 40 and facilitate the removal of the roll bar 40. The telescoping members of the roll bar 40 may be advantageously made of the same materials as the frame 28 and have a matching color.

Alternative supports which are insertable into the hollow core 44 of a rolled tissue product 24 and allow the rotation of the rolled tissue 24 thereon, such as alternative telescoping roll bars, a freely extending cylindrical or J-shaped projection, are also well known and may be combined with the housing 26 to provide for the dispensing of a dry rolled tissue product.

The illustrated frame 28 includes a lower space 46 in which a portion of the dry bathroom tissue 24 is located after the dry tissue 24 is mounted on the roll bar 40. As can be seen in FIG. 1, the frame 28 may also include reinforcing ribs 48 which both provide strength to the frame 28 and help the user of the dispenser 20 to locate the apertures 34 when installing the roll bar 40.

The illustrated cover 30 also includes a recessed portion 29 which allows the cover to be easily grasped when opening the cover 30. Adjacent the recessed portion 29, a latching projection 31 extends from the cover and is received by recess 27 located in the frame 28. The latching projection 31 may engage the recess 27 with an interference or snap fit relationship whereby the engagement of the latching projection 31 with the recess 27 maintains the cover 30 in a closed position. Downward pressure on recessed portion 29 disengages the projection 31 and recess 27 to allow the cover 30 to be opened. The recessed portion 29 may advantageously employ a different surface texture or color adjacent the latching projection 31 to indicate where pressure should be applied to open the cover 30. The illustrated recess 27 is positioned to be generally hidden from view when the cover 30 is in a closed position. A large variety of different methods and mechanisms for retaining a cover to a frame are known and may be substituted for the illustrated latching method.

The cover 30 may be advantageously formed out of material which permits a user of the dispenser to determine the amount of premoistened wipes remaining in the interior space 32 without opening the cover 30. Alternatively, a small portion of the cover 30 may be clear or partially clear to permit an external visual determination of the amount of premoistened wipes 22 which remain in the interior space 32. The cover 30 may be advantageously formed by an injection molding process using a polycarbonate material.

The illustrated dispenser 20 also includes a removable tray 50. The tray 50 includes a liquid retaining receptacle portion 52 which faces upward when the tray is placed within the dispenser 20. When positioned in the dispenser 20, the tray 50 defines the lower boundary of the interior space 32 in which the premoistened wipes 22 are placed. The tray 50 may be removed by merely opening the cover 30 without dismounting the frame 28.

The liquid retaining receptacle portion 52 of the illustrated embodiment is formed by an impermeable lower surface 54 and several upwardly extending walls which define a volume at the lower portion of the tray 50. The receptacle portion 52 of the tray collects excess solution from the premoistened wipes 22 and thereby prevents the excess solution from soiling or wetting the other components of the dispenser or the dry tissue 24 supported by the dispenser 20. Any excess solution remaining in the receptacle portion 52 after depleting the premoistened wipes 22 can be easily discarded by removal of the tray 50.

The removeability of the illustrated tray 50 also facilitates the reuse of the tray 50 by allowing the tray 50 to be removed for cleaning. For example, the tray 50 may be conveniently rinsed out in a bathroom sink. Additionally, by manufacturing the removable tray 50 entirely out of materials which are resistant to hot water having a temperature of approximately 180–210° F. (82–99° C.), the tray may be cleaned by placing it in a dishwasher. To facilitate the cleaning and disinfecting of the tray and other dispenser components, it is also advantageous that the materials used to form the tray and other components be resistant to isopropol alcohol, or solutions containing up to 70% isopropol alcohol, and be capable of withstanding disinfecting irradiation. The tray and other dispenser components may be advantageously formed by an injection molding process using an acrylonitrile butadiene styrene (ABS), polycarbonate, polypropylene, polyethylene, acetal or other suitable material. Those having ordinary skill in the art will recognize that these parts may be formed using a variety of alternative known materials and manufacturing techniques, e.g., machining.

Figure 19:
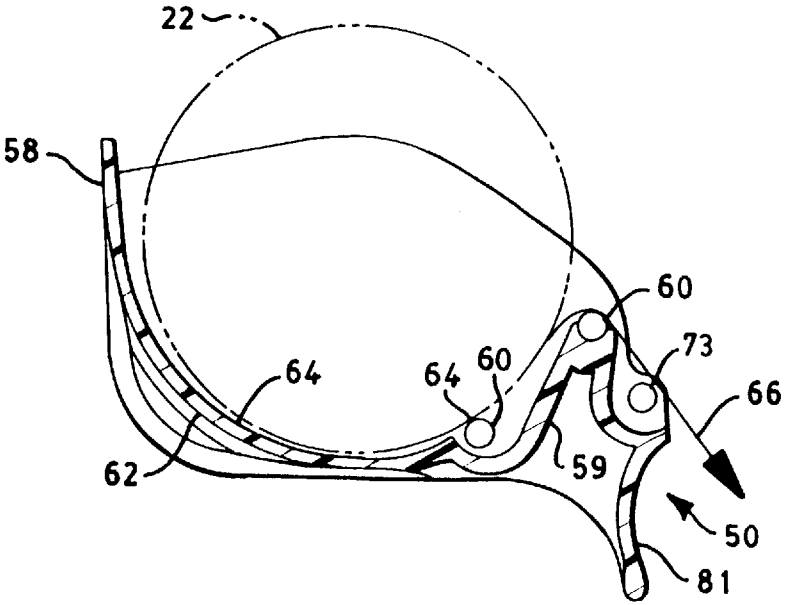
FIG. 19 is a cross sectional view of the tray taken along line A—A of FIG. 6.
Figure 18:
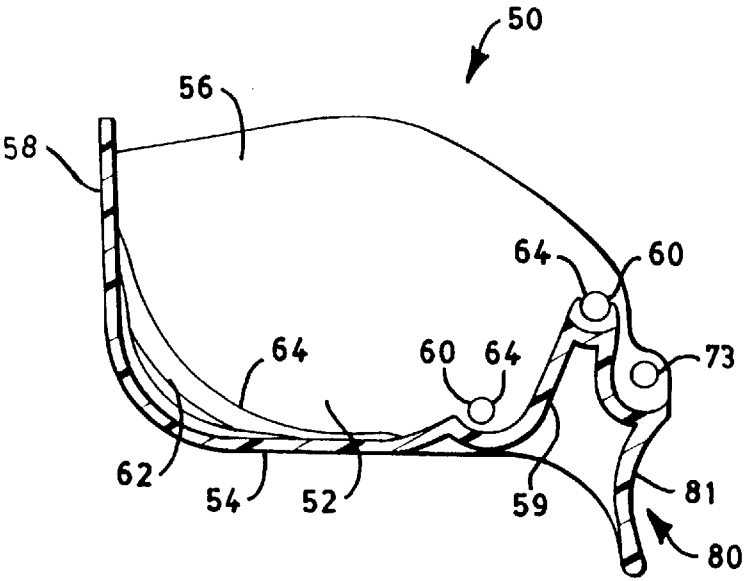
FIG. 18 is a cross sectional view of the tray taken along line B—B of FIG. 6.
Figure 22:
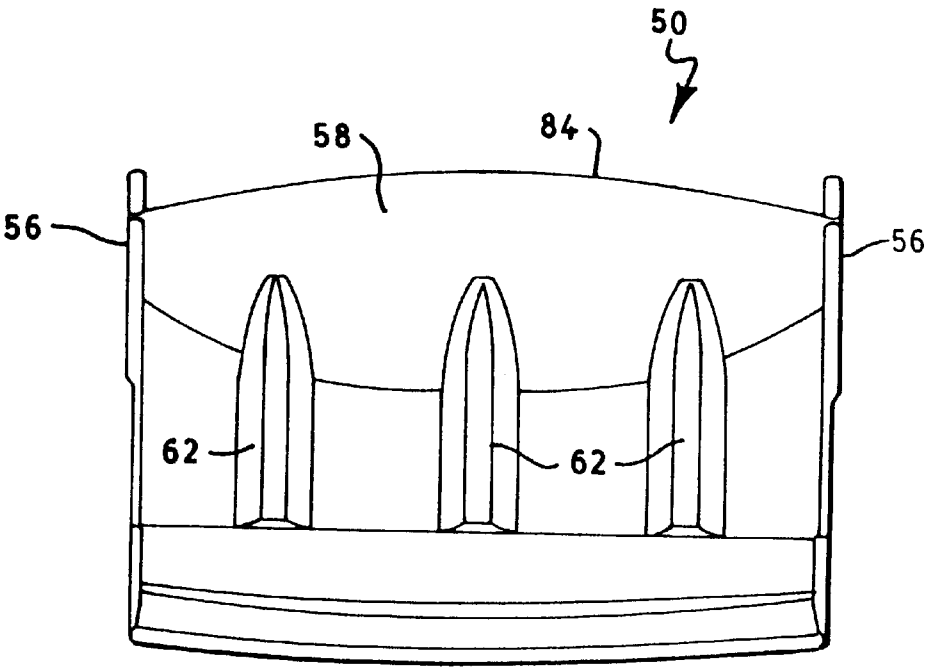
FIG. 22 is a top view of the tray.

When a roll of premoistened wipes 22 is placed in the tray 50 as shown in dashed outline in FIG. 19, the solution contained within the wipes may migrate downwards possibly leaving the wipes located on the upper portion of a stationary roll 22 with less moisture. The dispensing of the wipes, however, will cause the roll 22 to rotate within the tray and the solution retained by the receptacle portion 52 of the tray 50 will enhance the rewetting of the entire roll as it rotates within the tray.

The use of a tray having an impermeable lower surface 54 which is positioned below the wipes 22 and which does not form a liquid retaining receptacle can inhibit the soiling or wetting of the other components of the dispenser provided that the wipes are not overly saturated with solution. The use of a tray 50 which does include a liquid retaining receptacle portion 52, however, will generally be more advantageous.

In the illustrated embodiment, a pair of oppositely disposed side walls 56 are connected by the lower surface 54 and a laterally extending wall 58. The illustrated side walls 56 are spaced at a distance of 4.6 inches (11.68 cm) to provide 0.05 inches (0.13 cm) of clearance on each side of a roll 22 having an axial length of 4.5 inches (11.43 cm). The shape and size of the walls 56, 58 also permits the tray 50 to be tipped when inserting the tray 50 and a roll of premoistened wipes 22 into the dispenser without having the roll 22 fall from the tray 50.

The lower surface 54 includes a raised portion having a support surface 64. The premoistened wipes are placed within the interior space 32 on the support surfaces 64. The illustrated support surfaces 64 are located on the upper surface of ribs 62 and on two laterally extending rollers 60.

A relatively small laterally extending wall 59 is located between the two rollers 60 opposite wall 58. As exemplified by walls 58, 59, a receptacle portion 52 may be provided with walls which extend in a generally upwards direction when the tray 50 is installed in the dispenser 20. In other words, the walls are not required to be oriented perpendicularly to the lower surface 54 or define a vertical plane.

The two laterally extending rollers 60 are disposed opposite the laterally extending wall 58 whereby a substantial portion of the lower surface 54 is disposed between the roller 60 and the laterally extending wall 58. The premoistened wipes are supported by the ribs 62 in the central portion of the tray 50 while the two rollers 60 provide support at the dispensing end of the tray 50. FIG. 19 includes an arrow 66 which illustrates a path along which the premoistened wipes may be dispensed as they are unwound from roll 22.

As best seen in FIG. 1, the premoistened wipes placed in the tray 50 may be a coreless roll of premoistened wipes 22 having an axis 23. The premoistened wipes 22 advantageously have perforations (not illustrated) extending parallel to the axis and separating individual sheets of the rolled premoistened material to enable one or more sheets of the material to be conveniently separated from the remainder of the roll in a manner similar to that commonly employed with conventional dry bathroom tissue. The absence of a hollow core allows more wipes to be provided for a given roll diameter and eliminates the need for a disposable core. Alternative forms of premoistened wipes may also be used with a dispenser having a removable tray. For example, a stack of flat or folded individual or interconnected wipes or a roll of wipes having a core may be used.

In the illustrated tray 50, the ribs 62 are oriented substantially perpendicular to the axes of the freely rotatable rollers 60 and the axis 23 of the roll of premoistened wipes 22. By providing ribs 62 having relatively thin support surfaces 64 oriented perpendicular to the axis 23 of the wipes 22, the surface area of the wipes in contact with the support surfaces 64 is minimized. The minimal bearing surface area provided by the ribs 62 allows the wipes 22 to be rotated thereon without excessive frictional resistance. The ribs 62 may also extend upwardly along a portion of the laterally extending wall 58 as shown in the illustrated embodiment. By extending the ribs 62 upwardly along the wall 58, the ribs 62 space the roll 22 from the wall 58 to minimize the area of contact, and frictional forces, between the interior of tray 50 and the roll 22.

Figure 12:
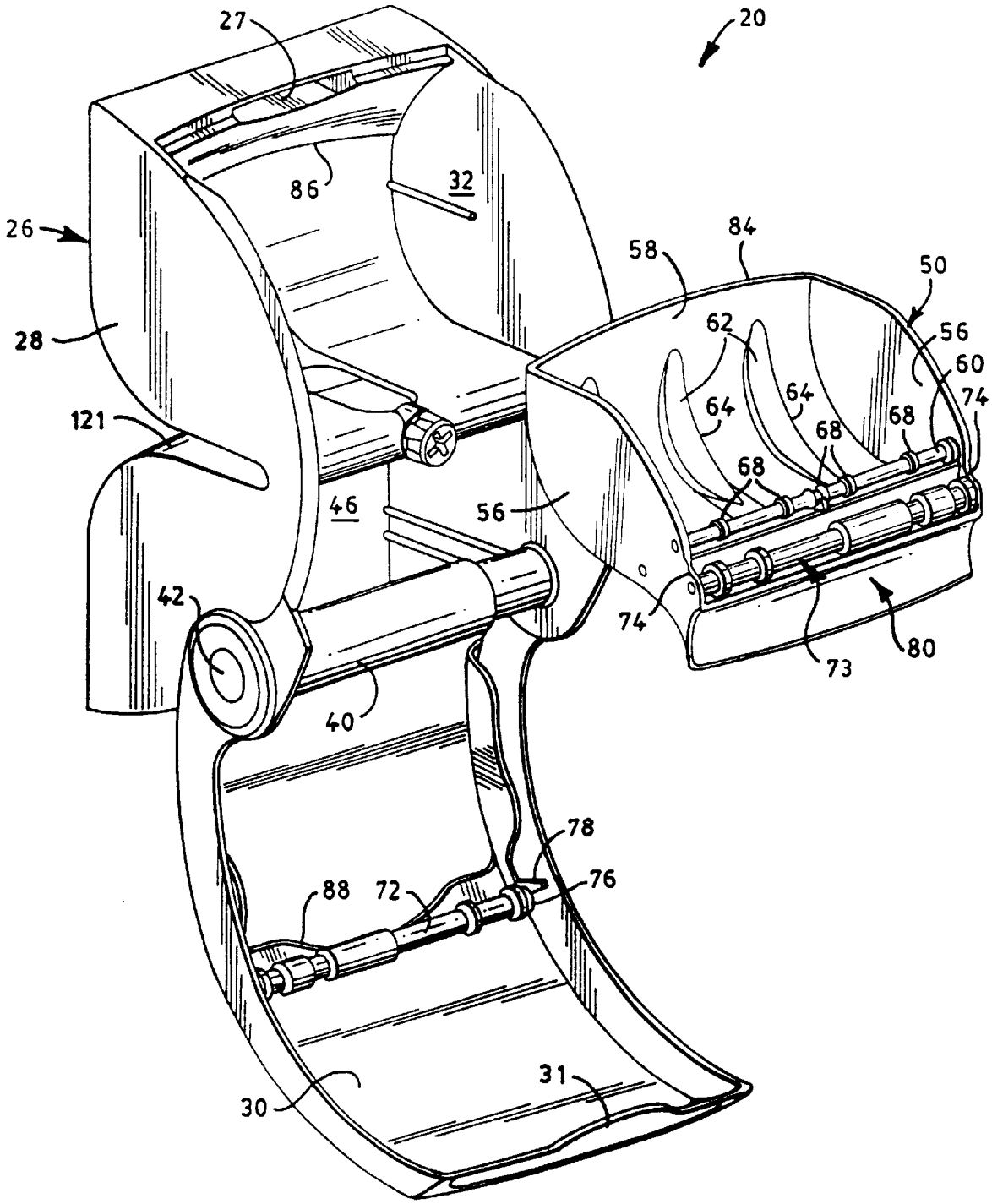
FIG. 12 is an exploded view of a tray and dispenser housing.
Figure 16:
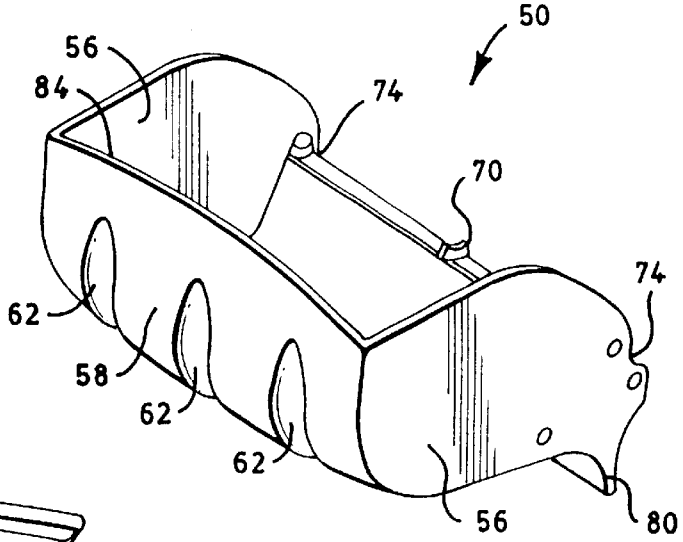
FIG. 16 is another perspective view of the tray.
Figure 15:
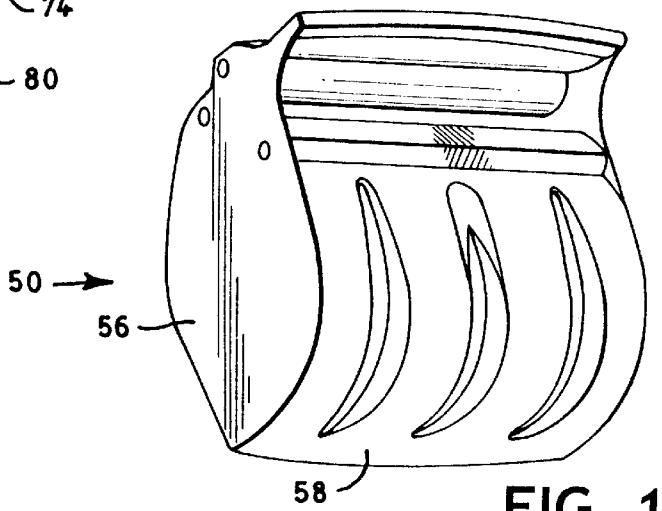
FIG. 15 is another perspective view of the tray.
Figure 14:
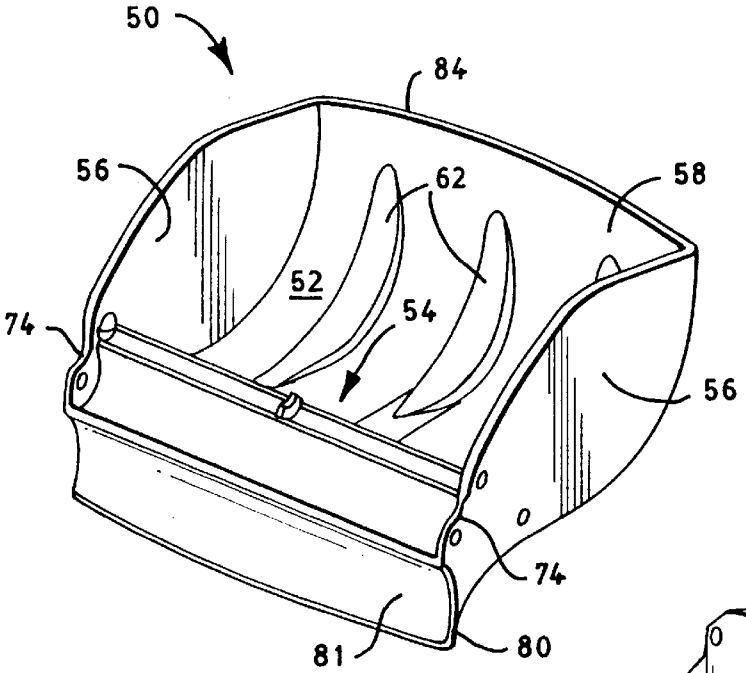
FIG. 14 is a perspective view of the tray.
Figure 17:
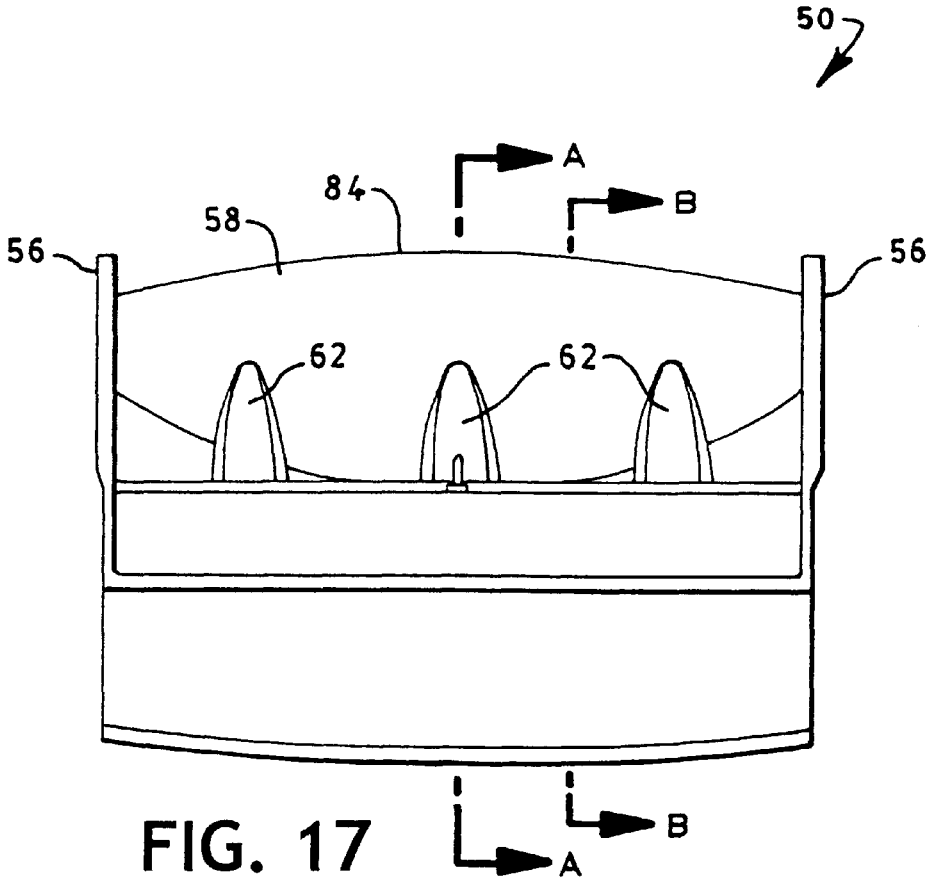
FIG. 17 is front view of the tray.
Figure 20:
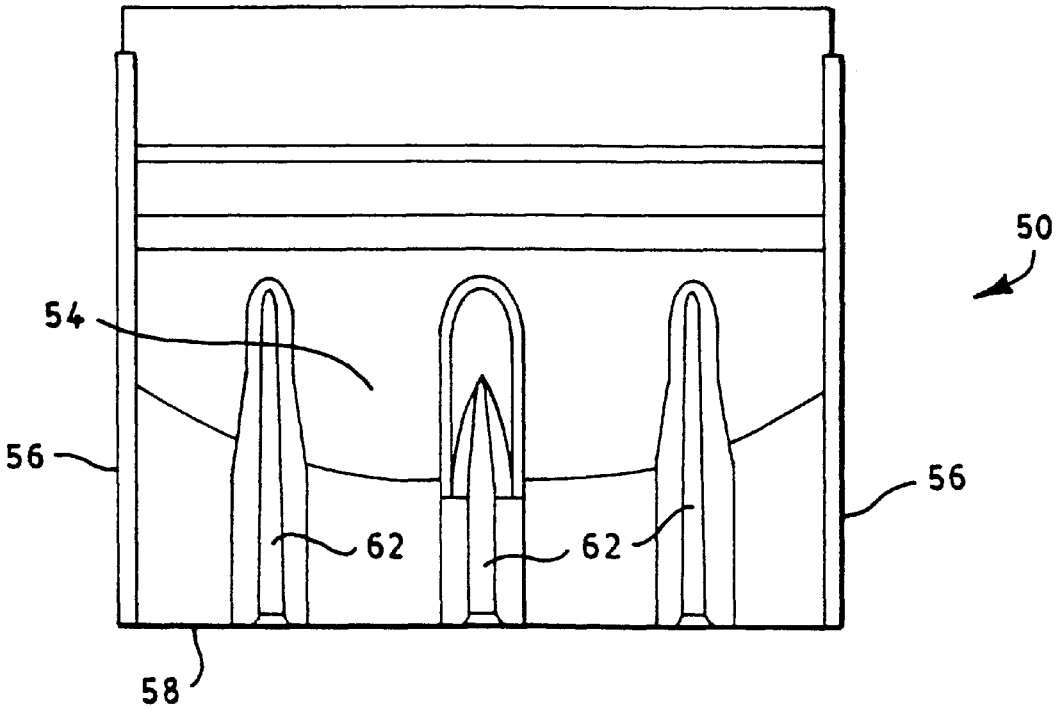
FIG. 20 is a bottom view of the tray.

The two rollers 60 are generally cylindrical with several spaced, cylindrical lands 68 having an increased diameter which provide support surfaces 64. The intermediate sections of rollers 60 which extend between lands 68 may also engage and support the premoistened wipes. The rollers 60 are rotatably supported by the tray 50 by inserting the ends of the rollers 60 into round apertures in the side walls 56. An intermediate support 70 is also provided for rotatably supporting one of the two rollers 60 as best seen in FIGS. 16 and 12.

The rollers 60 are disposed substantially parallel to the axis 23 of the rolled premoistened wipes 22 and are advantageously positioned to engage and support the rolled wipes near the side of the roll 22 from which wipes are being dispensed. As most easily seen with reference to FIG. 19, the roll of wipes 22 may be unwound by a user pulling the leading wipe which will move along the path indicated by the direction of line 66. As the leading wipe is being dispensed, the roll will be rotated and be pulled towards the rollers 60. The use of freely rotating rollers 60 provides a support for the roll 22 which enables the roll 22 to rotate with minimal frictional resistance.

A combination of both rollers 60 and ribs 62 are used in the illustrated tray 50 to provide a raised portion having a support surface and facilitate the rotation of the roll 22 within the tray 50. Alternative configurations for use with a roll of wipes 22, however, are also possible. For example, the roll 22 could be supported entirely by stationary support surfaces or rollers 60 and the stationary support surfaces or rollers could vary from those shown in the illustrated tray.

To load the tray with wipes, the premoistened wipes are positioned above the lower surface 54 and inward of the walls 56, 58. The wipes are conveniently placed into the tray 50 after first removing the tray 50 from the frame 28. Once the wipes have been placed in the tray 50 and the leading wipe draped over dispensing guide 73, the tray 50 and wipes 22 are then inserted into the interior space 32 as a single unit. Alternatively, the wipes 22 may be placed in the tray 50 while the tray is within the interior space 32.

After inserting the tray 50 and wipes 22, the cover 30 is closed whereby the leading wipe is engaged between the dispensing guide 73 located on the tray and the dispensing guide 72 located on the cover 30.

The illustrated dispensing guides 72, 73 are each rotatable about a longitudinally extending axis 72*a*, 73*a* and take the form of a cylinder having a plurality of lands 84 and grooves 86 along their longitudinal length. The dispensing guides 72, 73 have a pattern of lands 84 and grooves 86 which allow the land 84 of one dispensing guide 72 to be disposed opposite a groove 86 on the other dispensing guide 73. The illustrated pattern allows two identical dispenser guides to be employed by flipping one of the guides.

To ensure the proper positioning of the two dispensing guides 72, 73 when the cover 30 is placed in a closed position, the tray has a pair of engagement surfaces 74 located near the opposite lateral ends of the dispensing guide 73. The engagement surfaces 74 located on the tray 50 are engaged by a second pair of engagement surfaces 76 located on the cover 30 near the opposite lateral ends of the dispensing guide 72 (FIGS. 12 and 13).

Figure 13:
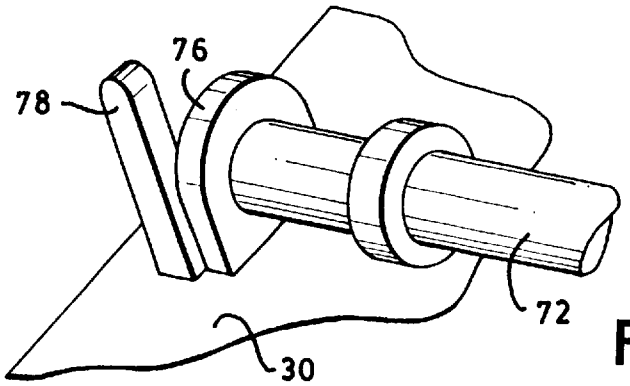
FIG. 13 is a partial perspective view of a dispensing roller.

FIG. 13 is an enlarged view of one of the lateral ends of the dispensing guide 72 located on the cover 30 and shows one of the engagement surfaces 76. The two pairs of engagement surfaces 74, 76 are engaged together when the cover 30 is placed in the closed position to facilitate the proper alignment of the two dispensing guides 72, 73. Also shown in FIG. 13 is a lateral alignment guide 78. The side walls 56 of the tray 50 are located between the two lateral alignment guides 78 when the cover 30 is closed and the two pair of engagement surfaces 74, 76 are engaged. The alignment guides 78 thereby prevent relative lateral movement between the cover 30 and the tray 50 and facilitate the proper lateral alignment of the two dispensing guides 72, 73.

In addition to the engagement surfaces 74, 76 which are located above the dispensing guide 73, the cover 30 and tray 50 also include another set of engagement surfaces on the opposite, lower side of the dispensing guide 73. These additional engagement surfaces are provided on a grip 80 located on the tray 50 and by projections 82 located on the cover 30. The grip 80 defines a laterally extending arcuate surface 81 which is engageable at its lateral ends by the projections 82. The arcuate grip surface 81 and projections 82 thereby contribute to the proper alignment of the cover 30 and the tray 50 and the dispenser guides 72, 73 located thereon.

The grip 80 is positioned so that it may be grasped when inserting or removing the tray 50 from the dispenser 20. The illustrated grip 80 not only provides a thin, easily gripped projection but the portion of the illustrated grip 80 which forms the exterior surface 81 which is visible when the dispenser is in a closed position also contributes to the aesthetic outward appearance of the dispenser 20 and conceals the threaded fastener 138.

In addition to the engagement of the grip 80 and the projections 82, the tray 50 may also be held in place by the engagement of the top edge 84 of wall 58 with a notch 86 in the interior surface of the frame 28. The engagement of edge 84 and notch 86 prevents the tray 50 from tipping forward as the leading wipe is being pulled during the dispensing process. The use of an arcuate edge 84 and notch 86, which are horizontally as well as vertically engageable, also helps to laterally locate the tray 50 within the frame 28. The top edge 84 may alternatively have a key, such as an upstanding tab, or key-way engageable with either a key-way or key on the frame 28 to securely position the tray 50 within the frame 28.

After inserting the tray 50 and wipes 22 into the dispenser, the wipes may be dispensed by pulling the leading wipe and separating a length of premoistened wipes from the remainder of the roll 22 by tearing the wipe material along a row of perforations separating the individual wipes. The removal of the wipes leaves a new leading wipe engaged between the dispenser guides 72, 73. The dispensing process may be repeated until the supply of wipes in the tray is depleted whereupon the tray 50 may be removed from the dispenser 20 and the wipes replenished.

Figure 8:
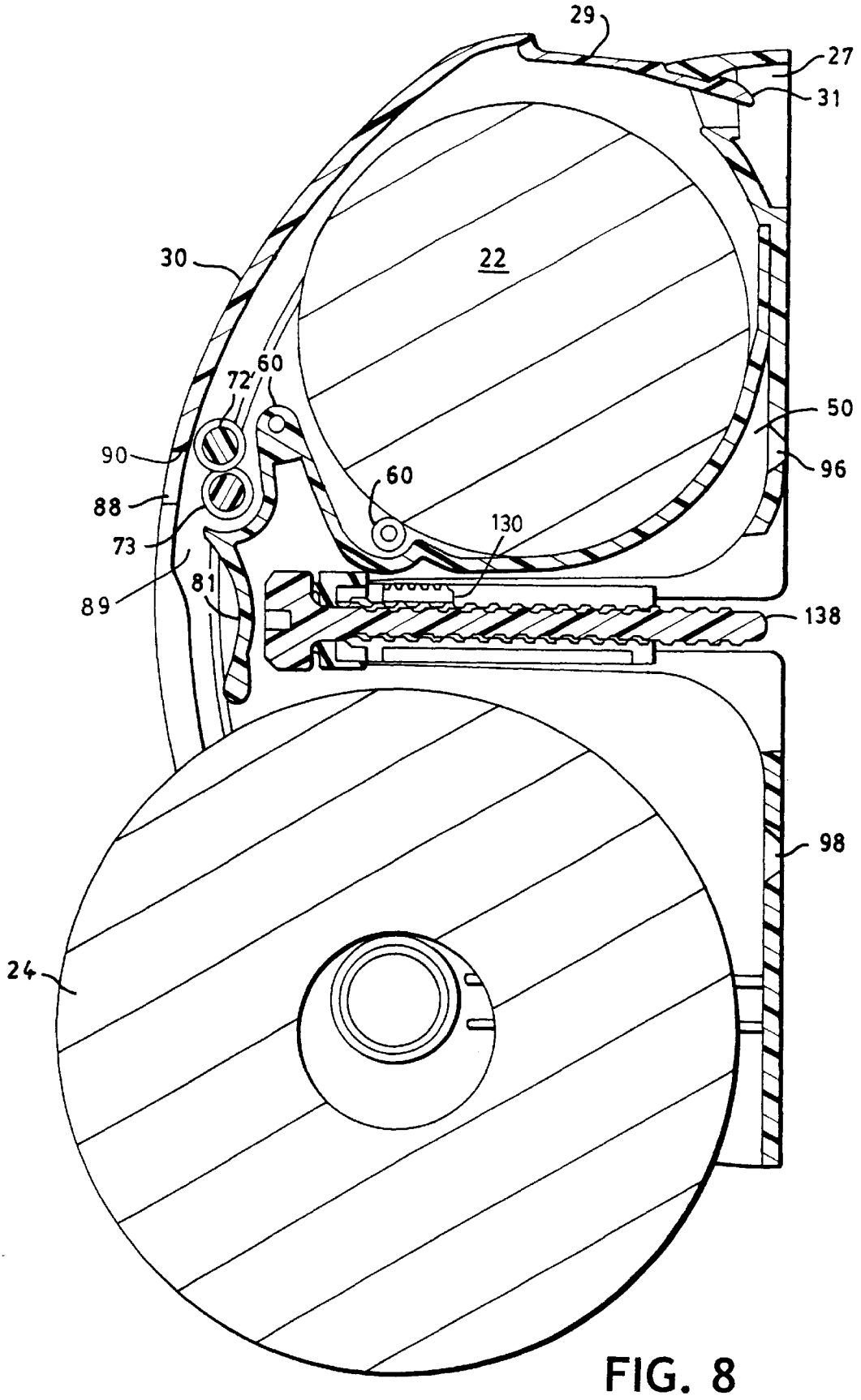
FIG. 8 is a cross sectional view taken along line 8—8 of FIG. 4.

A dispenser 21 which does not include projections 82 for engaging grip 80 is illustrated in FIGS. 3–8. FIG. 8 presents a cross sectional view taken along line 8—8 of FIG. 4 and illustrates the relationship between the dispensing guides 72, 73 and the impingement surface 88 of the representative embodiment. The impingement surface 88 is formed by an edge of the cover 30 and defines an edge of a dispensing opening 89.

Figure 9:
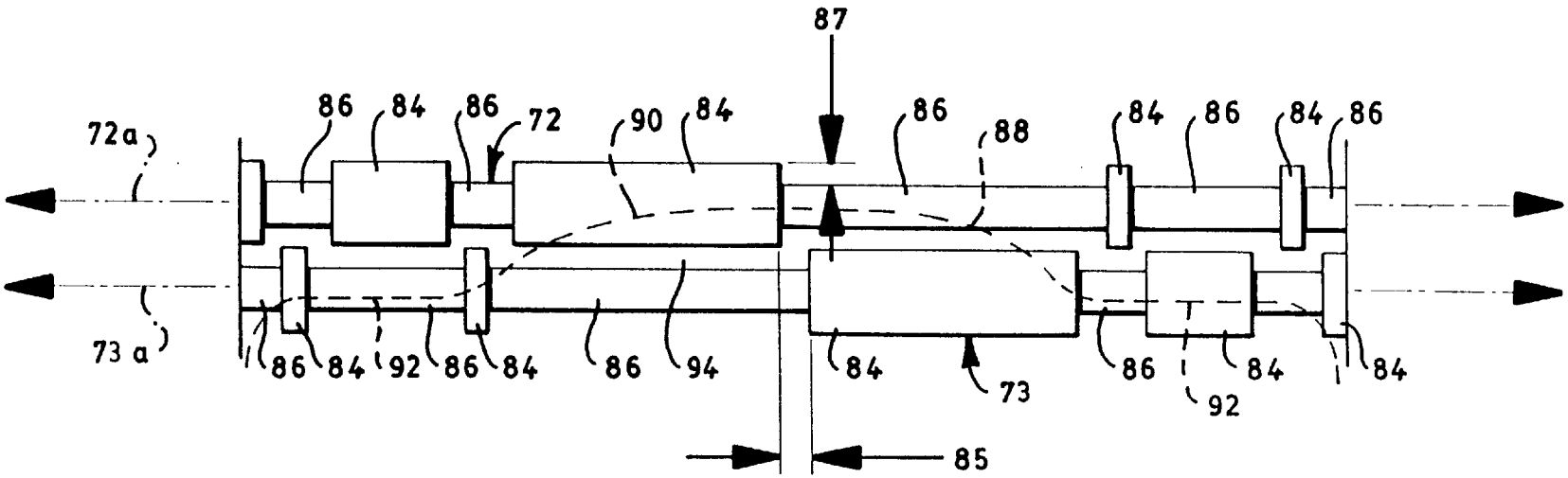
FIG. 9 is a front view of the dispensing rollers.
Figure 10:
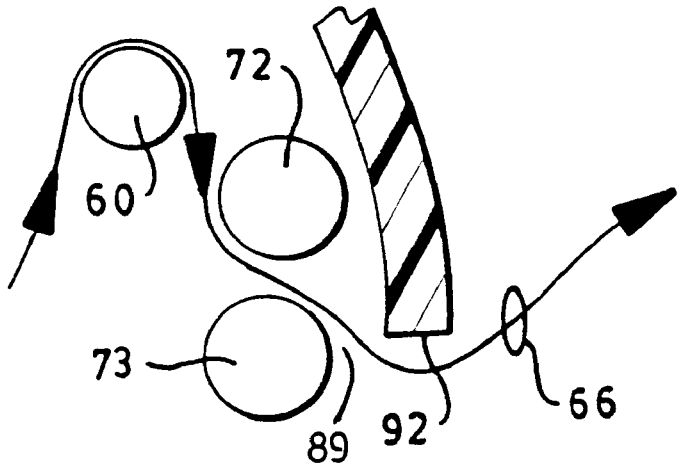
FIG. 10 is a schematic cross sectional view of the outer portion of the dispensing rollers.
Figure 11:
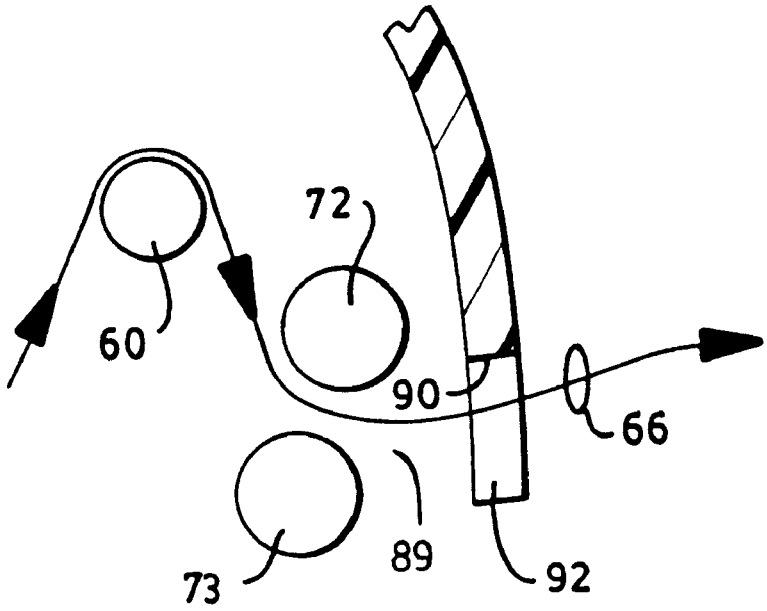
FIG. 11 is a schematic cross sectional view of the central portion of the dispensing rollers.

As schematically illustrated in FIGS. 9–11, the impingement surface 88 and opening 89 extend adjacent the dispensing guides 72, 73 when the cover 30 is in a closed position. As seen in FIG. 9, the impingement surface 88 includes a central portion 90 and two outer portions 92 located on opposite sides of the central portion 90. The central portion 90 is located at a first relative position with respect to the dispensing guides 72, 73 and the gap 94 formed between the guides 72, 73 through which the wipes are dispensed. The outer portions 92 of the impingement surface 88 are located at different relative positions to the dispensing guides 72, 73 than the central portion 90. The central portion 90 of the impingement surface 88 may advantageously have a generally rounded or curvilinear shape and be farthest from the gap 94 at the midpoint of the surface 88.

Figure 28:
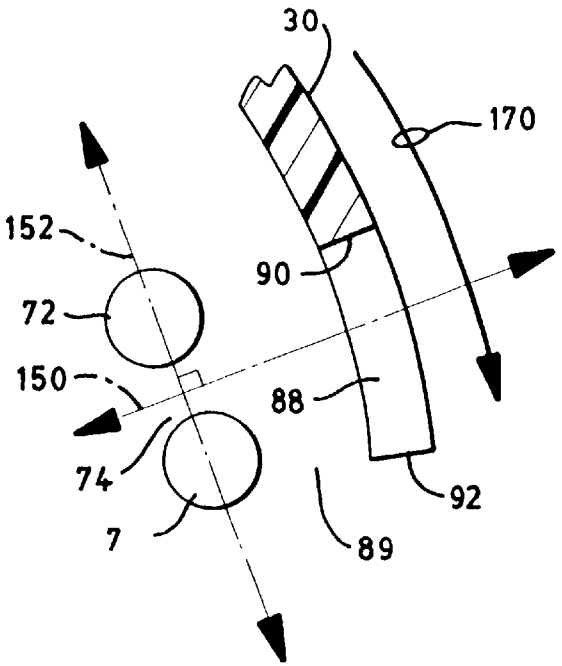
FIG. 28 is a schematic view of a dispensing system in accordance with the present invention.

With reference to FIGS. 9 and 28, the central portion 90 may be located on one side of the gap 94 and the outer portions 92 are located on the opposite side of the gap 94 when viewing the gap 94 at a normal angle. More specifically, a flat plane 150 intersecting the gap 94 and oriented perpendicularly to a plane 152 connecting the axes 72*a*, 73*a* of the dispenser guides 72, 73, lies within the dispensing opening 89 adjacent the central portion 90 of the impingement surface 88 while the outer portions 92 of the impingement surface 88 lie on the opposite side of the flat plane 150. Access to the central portion of the gap 94 is relatively unobstructed in such a configuration.

Figure 29:
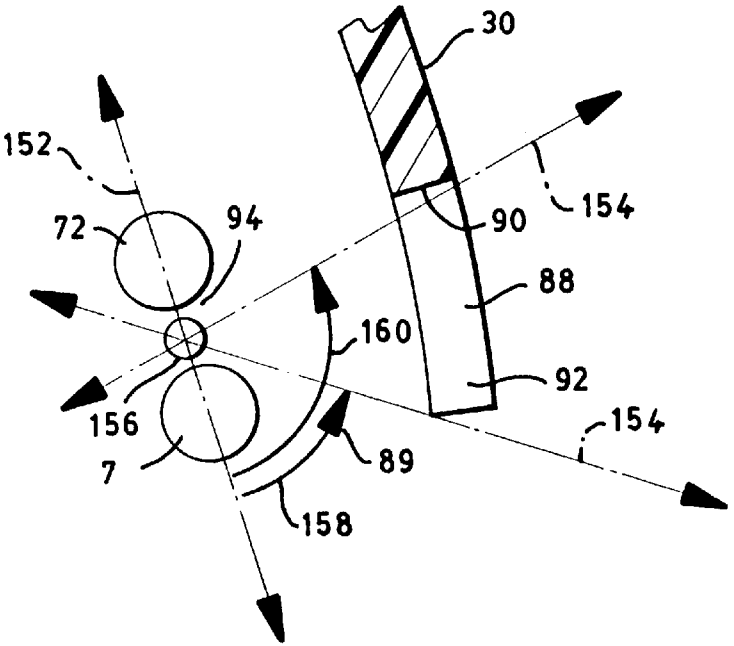
FIG. 29 is another schematic view of a dispensing system in accordance with the present invention.

With reference to FIG. 29, it can be seen that the illustrated dispensing system includes an impingement surface 88 having a central portion 90 which is disposed relative to the outer portions 92 to provide a more directly accessible gap 94 in the center of the dispensing opening 89. More specifically, a flat plane 154 intersecting the gap 94 and extending through the opening 89 will contact the two outer portions prior to contacting the central portion of the impingement surface when rotated about a line 156 (oriented perpendicular to the view and shown as a point in FIG. 29) of intersection with the gap 94 toward the impingement surface 88. As can be seen in FIG. 29, when rotated from a common location from the opening 89 toward the impingement surface, the plane 154 will rotate an angular distance 158 prior to contacting the outer portions 92 of the impingement surface 88 while the plane 154 must be rotated by a greater angular distance 160 to contact the central portion 90 of the illustrated impingement surface 88.

Figure 30:
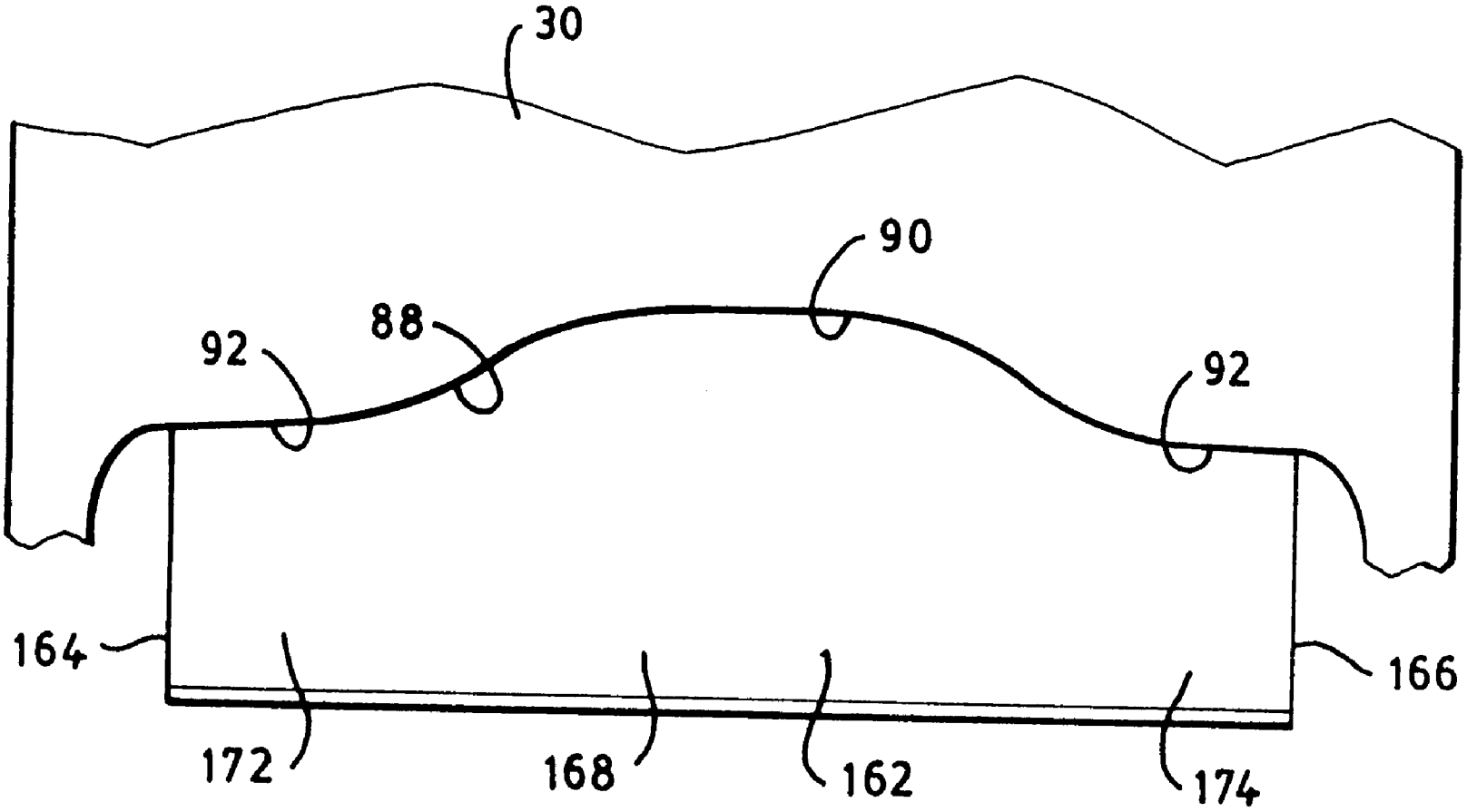
FIG. 30 is a partial view of a dispenser and a wipe.

The dispensing of wipes is best seen in FIGS. 10, 11 and 30. FIGS. 10 and 11 are schematic cross sectional representations which illustrate the direction of travel 66 of a wipe which is being dispensed. FIG. 30 provides a front view of a leading wipe 162 which may be grasped by a user. Each of the individual premoistened wipes provided on roll 22 includes a first side edge 164 and an opposite second side edge 166.

The leading wipe 162 is placed in the gap 94 in a substantially flat configuration when the gap 94 is formed between the two longitudinally extending dispensing guides 72, 73. This is accomplished in the illustrated embodiment by inserting the tray 50 into the dispenser 20 and closing the cover 30. After loading the premoistened wipes in the dispenser 20, the first and second side edges 164, 166 of the leading wipe 162 are disposed on opposite sides of the gap 94 and a forward edge 168 of the leading wipe 162 extends through the gap 94 where it may be easily grasped and dispensed.

The impingement surface 88 extends into the space through which the wipes are dispensed after passing through the gap 94. The impingement surface 88 extends in a direction 170 (FIG. 28) impinging on the wipe being dispensed. Thus, when the user pulls on the leading wipe to dispense one or more wipes, the impingement surface 88 may be engaged by the leading wipe 162. The wipe engages the outer portions 92 of the impingement surface 88 in first 172 and second 174 areas proximate the first 164 and second 166 side edges of the wipe. The outer portions 92 of the impingement surface 88 extend a greater distance than the central portion 90 in the impingement direction 170. Consequently, during the dispensing process, the outer portions 92 more forcibly engage the wipe than the central portion 90 of the impingement surface.

The outer portions 92 of the impingement surface may thereby provide a bearing surface against which the wipe may be pulled to initiate the separation of the dispensed wipes from the remaining wipes. During the separation process, the wipes are typically subjected to a lateral force which must be resisted to prevent the wipes from "skating" between the dispenser guides 72, 73 and "bunching up" at one location between the dispenser guides 72, 73.

The use of dispensing guides 72, 73 having corresponding lands 84 and grooves 86 provides resistance to the "skating" or "bunching up" of the wipe when the dispensed wipes are separated from the remainder of the premoistened wipes. In the illustrated embodiment, the lands 84 and grooves 86 of the dispensing guides 72, 73 are coordinated with the outer 92 and central 90 portions of the impingement surface whereby there are more alternations between lands 84 and grooves 86 adjacent the outer portions 92 of the impingement surface 88. As best seen in FIG. 9, the lands 84 and grooves 86 of the illustrated dispensing guides 72, 73 have a greater average longitudinal length adjacent the central portion 90 of the impingement surface 88 than the outer portions 92 of the impingement surface 88. The shorter average longitudinal length of the lands 84 and grooves 86 adjacent the outer portions 92 of the impingement surface 88 results in a higher concentration of alternations between the lands 84 and grooves 86 adjacent the outer portions 92 of the impingement surface 88.

The alternations between lands 84 and grooves 86 adjacent the outer portions 92 of the impingement surface 88 provide resistance to the "skating" or inward migration of the side edges 164, 166 of the wipe being dispensed. Increasing the number of alternations between the lands 84 and grooves 86 can provide an increased resistance to the skating of the wipe. Providing non-smooth texture, such as knurling, on the dispensing guides 72, 73 may also provide resistance to the skating of the wipes.

With reference to FIG. 9, when using wipes having a thickness of 0.010 inches (0.025 cm) it has been found advantageous to use dispensing guides 72, 73 wherein the outside diameter of the lands 84 is 0.380 inches (0.965 cm) and the outside diameter of the grooves 86 is 0.270 inches (0.686 cm). The radial distance 87 (FIG. 9) separating the lands 84 and grooves 86 at a transition point between a land and groove is consequently 0.055 inches (0.140 cm). It has been found advantageous to employ a longitudinal distance 85 separating adjacent transition points on the two dispensing guides which is three times larger than the distance 87 separating the land and groove surfaces.

The gap 94 is advantageously sized to be smaller than, or approximately equivalent to, the thickness of the wipes 22 whereby the wipes will contact both of the dispensing guides 72, 73 as the wipes pass through the gap 94. For example, a gap 94 providing a clearance distance of 0.010 inches (0.025 cm) between the dispensing guides 72, 73 may be used with a wipe having a thickness of 0.015 inches (0.038 cm). It is noted that the directional lines 66 shown in FIGS. 10 and 11 merely indicate the path of travel of the wipe material without representing the thickness of the wipe.

Alternative embodiments of the invention may employ different dimensions for the gap 94, lands 84 and grooves 86. For example, alternative dimensions for the dispensing guides 72, 73 and gap 94 may be employed with wipes having similar thicknesses. The use of alternative dimensions for the dispensing guides 72, 73 and gap 94 may also be employed for wipes having different thicknesses. For example, it may be advantageous for wipes having a thickness in the range of 0.300 mm (0.012 inches) to 1.300 mm (0.051 inches) to employ gaps 94 in the range of 0.178 mm (0.007 inches) to 1.17 mm (0.046 inches) wherein the gap size varies linearly with the wipe thickness. These combinations of wipe thickness and gap 94 size are merely illustrative and alternative combinations may also be employed.

Different sized gaps 94 can be easily provided with the same dispenser by exchanging one or both of the dispensing guides 72, 73. For example, to provide a larger gap 94, the illustrated dispensing guides 72, 73 could be exchanged for guides which have lands and grooves with smaller diameters than the illustrated dispensing guides discussed above. Although rotatable dispensing guides 72, 73 are shown in the representative embodiment, alternative embodiments may employ stationary surface to form a gap 94. Furthermore, by resiliently biasing one of the dispenser guides towards the second dispenser guide, such as by one or more springs, a dispenser having a variable gap 94 may be provided.

In addition to facilitating the separation of the dispensed wipes, the engagement of a wipe by the outer portions 92 of the impingement surface 88 may also produce a drag on the wipe during the dispensing process. The central portion 90 of the impingement surface 88 may also engage and produce a drag on the wipe. Depending upon the angle at which the wipe is pulled during dispensing, however, the premoistened wipes may not engage the central portion 90 of the impingement surface 88 during the dispensing process.

Some drag is desired during the dispensing process to prevent an excessive quantity of wipes from being dispensed as a result of a minor pulling motion. In the illustrated embodiments, it has been found that an advantageous level of drag can be produced by positioning approximately equal amounts of the impingement surface 88 on opposite sides of flat plane 150.

A mounting device may be used to support the dispenser 20 on a conventional bathroom tissue fixture having a pair of opposed recesses for receiving a telescoping roll bar. A suitable mounting device is described in detail in a commonly assigned U.S. patent application entitled "Mounting Device" having an Attomey Docket No. 14,674 filed Apr. 30, 1999, the disclosure of which is hereby incorporated by reference. The disclosures of a commonly assigned U.S. patent application entitled "Dispenser and Tray for Premoistened Wipes" having Attorney Docket No. 14,675 and filed Apr. 30, 1999 and a commonly assigned U.S. Provisional Patent Application entitled "Dispenser for Premoistened Wipes" having Attomey Docket No. 14,676 and filed Apr. 30, 1999 are both hereby incorporated by reference.

Figure 21:
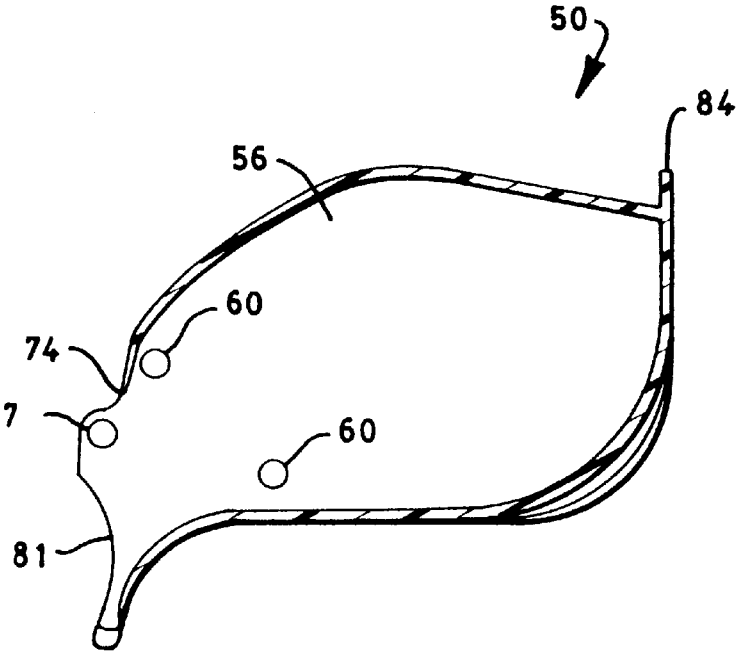
FIG. 21 is a side view of the tray.
Figure 24:
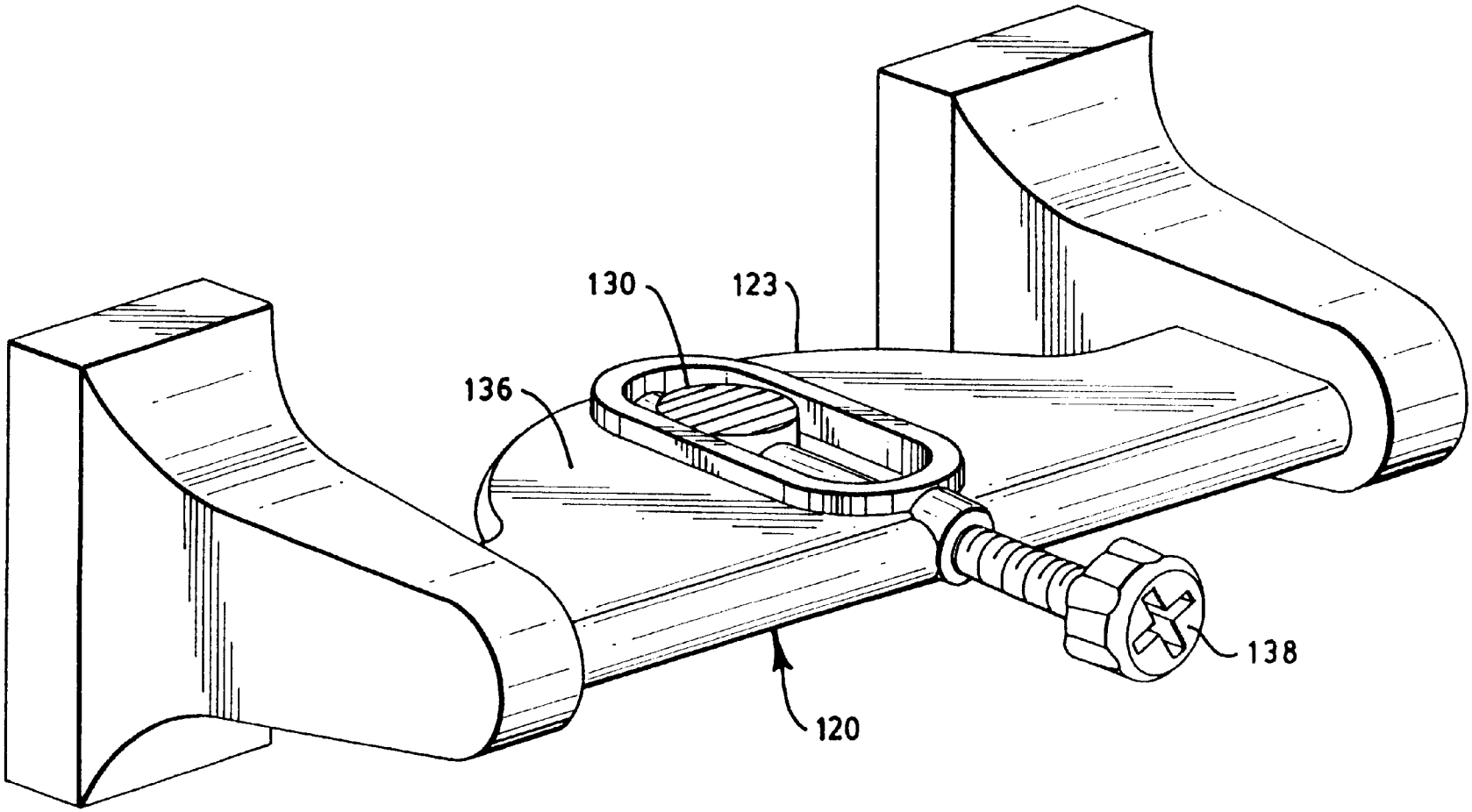
FIG. 24 is a perspective view of a mounting device and a bathroom tissue fixture.
Figure 25:
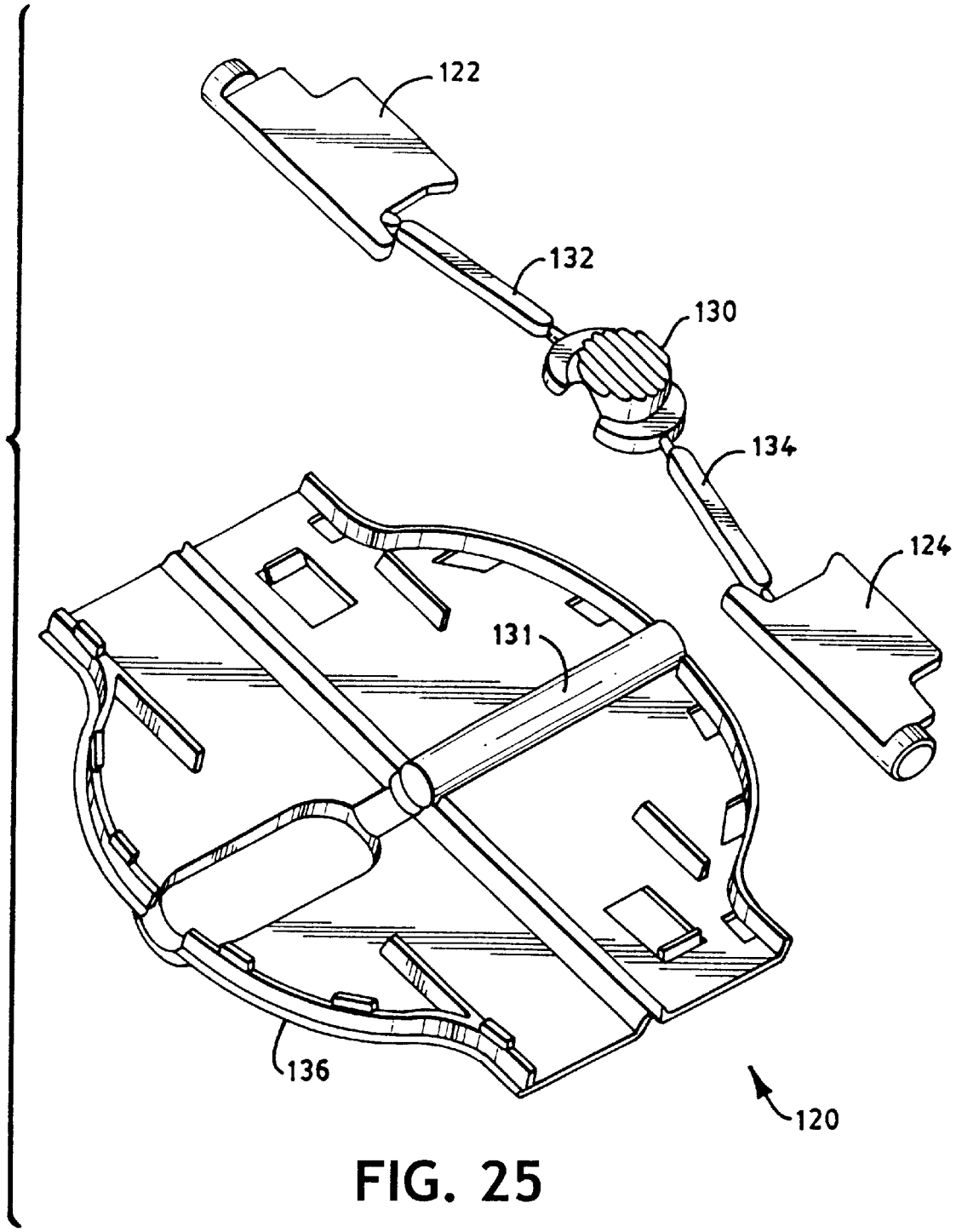
FIG. 25 is an exploded view of a mounting device.
Figure 26:
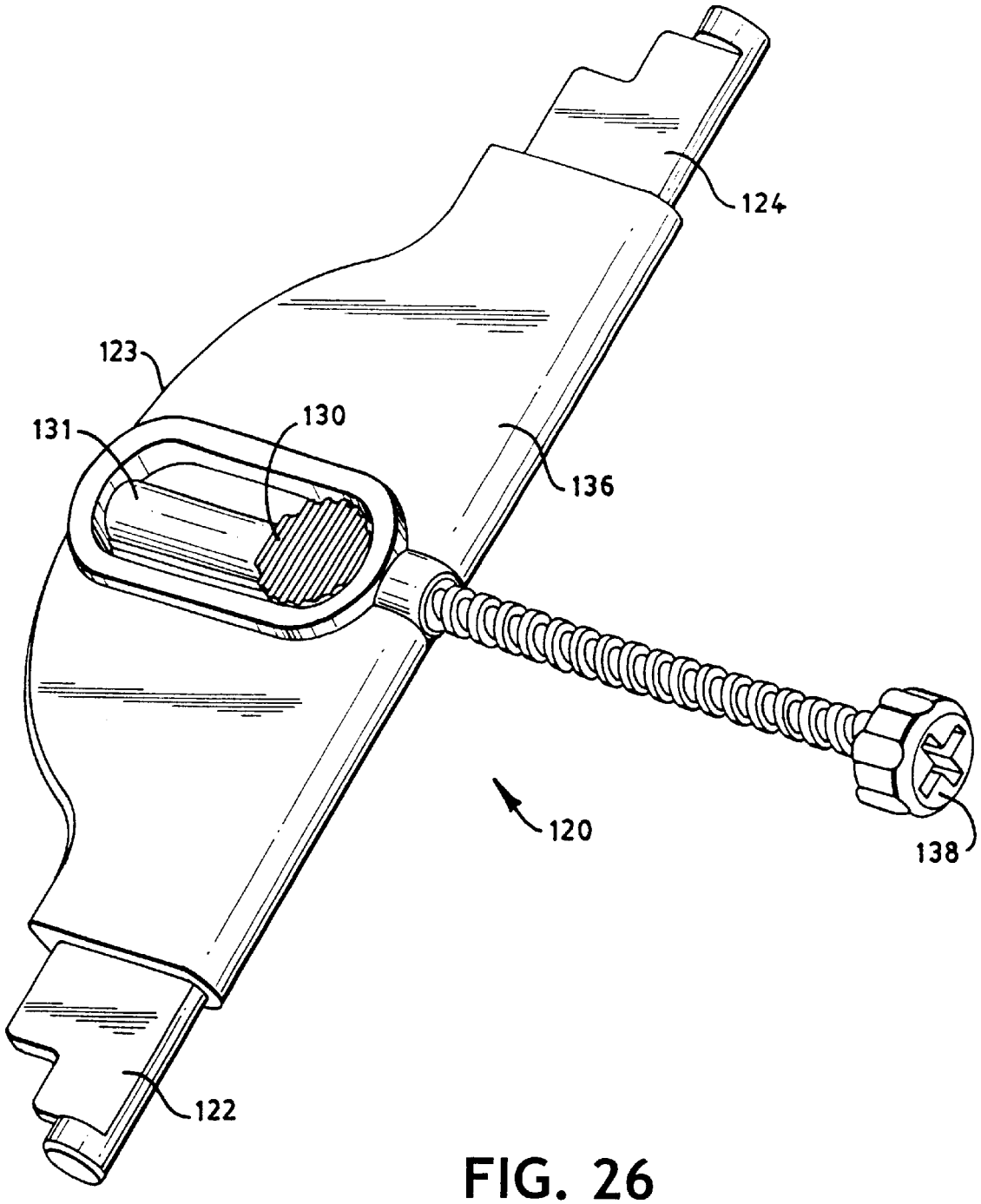
FIG. 26 is a perspective view of a mounting device.

The mounting device 120 illustrated in FIGS. 24–26 includes two support members 122 and 124 which are connected to a positioning member 130 by linkages 132 and 134. As best seen in the exploded view of FIG. 21, the positioning member 130 may be seated over the cylinder 131. The support members 122, 124 are received within the housing 136 and the housing 136 is folded to trap the support members 122, 124 within the housing as illustrated in FIG. 26. A threaded bore hole extends the entire length of cylinder 131 and a threaded fastener 138 may be engaged with the mounting device 120 at either end of the cylinder 131. The threaded fastener 138 may be used to attach the mounting device 120 to a dispenser 20.

As shown in FIG. 24, the mounting device 120 may be used with conventional bathroom tissue fixtures. The user may manually move the positioning member 130 whereby the linkages 132 and 134 force the support members 122, 124 outward to engage the oppositely disposed recesses of the fixture. The mounting device 120 fits within a slot 121 in the frame 28 and is secured to the frame 28 with fastener 138. To accommodate a wide variety of conventional fixtures, the mounting device 120 can be secured at different positions along slot 121. For recessed fixtures, the mounting device 120 can be turned so that the curved end 123 of the mounting device 120 is inserted first into the slot 121 and the support arms 122, 124 can be located behind the rear surface 100 of the dispenser 20. Altemative mounting devices for attaching the dispenser 20 to a conventional bathroom tissue fixture may also be employed.

Figure 27:
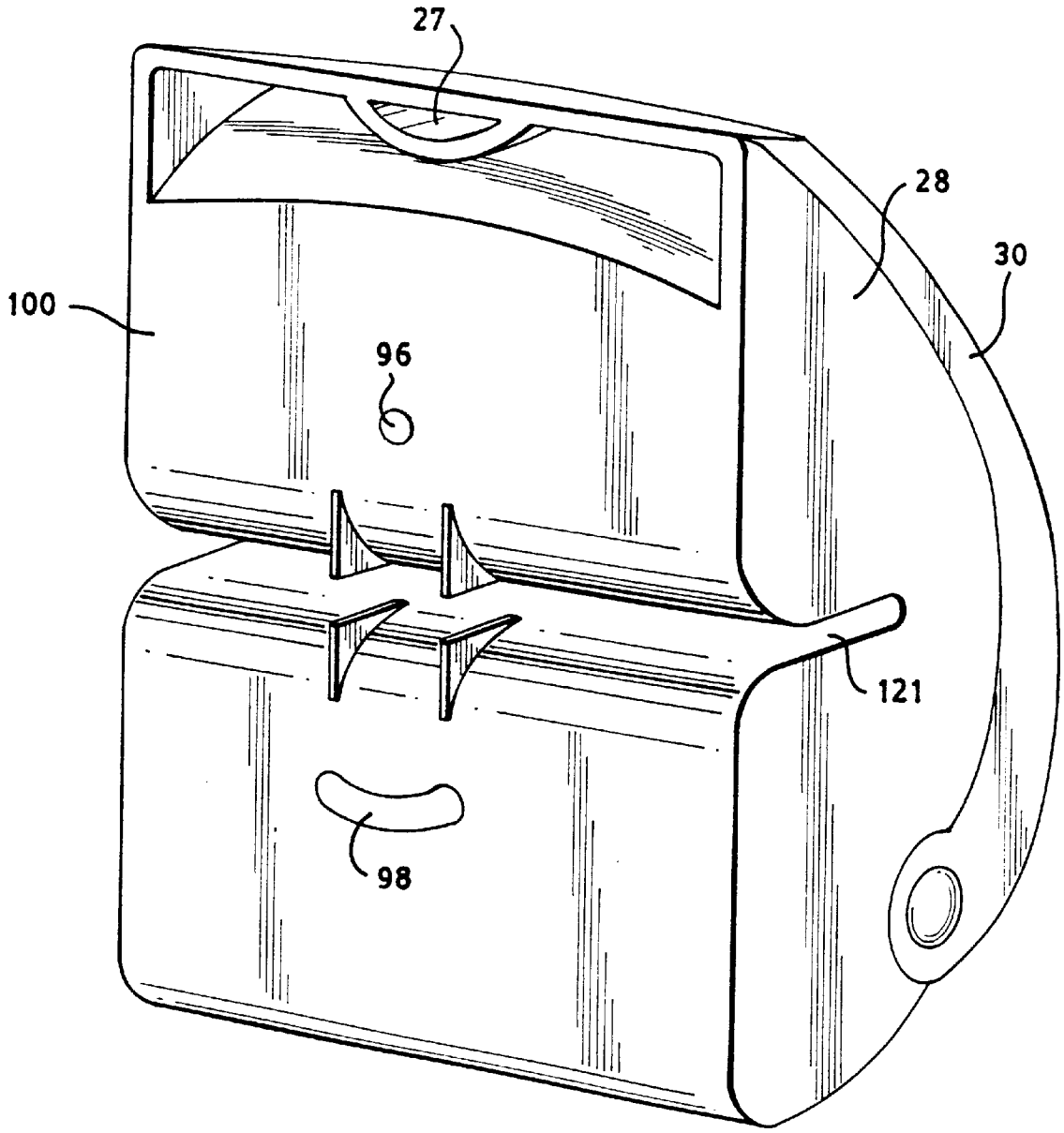
FIG. 27 is a perspective view of the rear of the dispenser.

The dispenser may also be directly mounted to a wall, cabinet panel or similar support by inserting fasteners through apertures located in the rear surface of the frame 28. The apertures in the rear surface 100 of the frame 28 may include a round aperture 96 adapted to receive a threaded fastener therethrough. The aperture 96 may be advantageously positioned to correspond with the middle rib 62 of the tray whereby the void space defined by the rear of the middle rib 62 will overlay the head of the installed fastener to reduce the possibility of clearance difficulties between the fastener head and the tray. The rear surface of the frame 28 may also include another aperture 98 located below the above-described round aperture as shown in FIG. 27.

While this invention has been described in detail, it will be readily apparent to a person of ordinary skill in the art that various changes and modifications can be made without departing from the spirit and general principles of the invention. All of such changes and modifications are contemplated as being within the scope of the present invention as defined by the subjoined claims. Furthermore, this application is intended to cover such departures from the present disclosure as come within known or customary practice in the art.

What is claimed is:

1. A dispensing system for premoisteied wipes, said system comprising:

a first longitudinally extending dispensing guide;

a second longitudinally extending dispensing guide positionable substantially parallel and in proximity to said first guide to thereby define a gap between said first and second dispensing guides, the premoistened wipes being dispensed by passage through said gap and a dispenser opening, at least one of the guides being rotatable; and an impingement surface, said impingement surface defining an edge of said dispensing opening, said impingement surface having a first outer portion, a second outer portion, and a central portion, said central portion disposed between said first and second outer portions, said central portion disposed relative to said outer portions whereby a flat plane intersecting said gap and extending through said opening will contact said first and second outer portions prior to contacting said central portion when rotated about a line of intersection with said gap towards said impingement surface.

2. The dispensing system of claim 1 wherein said first and second dispensing guides are each rotatable about a longitudinally extending axis.

3. The dispensing system of claim 2 wherein said first and second dispensing guides each comprise a cylinder having a plurality of lands and grooves.

4. The dispensing system of claim 3 wherein an average longitudinal length of said lands and grooves is greater adjacent said central portion than adjacent said outer portions.

5. The dispensing system of claim 1 wherein said central portion has a substantially curvilinear shape.

6. The dispensing system of claim 1 further comprising a housing and a cover, said housing defining an interior space, the premoistened wipes being positionable within said interior space, said cover having an open position permitting access to said interior space and a closed position, said first and second dispensing guides being positioned to form said gap when said cover is in said closed position, and said impingement surface being disposed on said cover.

7. The dispensing system of claim 1 further comprising a housing and a cover, said housing defining an interior space, the premoistened wipes being positionable within said interior space, said cover having an open position permitting access to said interior space and a closed position, said first and second dispensing guides being positioned to form said gap when said cover is in said closed position, and said first dispensing guide being disposed on said cover.

8. The dispensing system of claim 7 wherein said first dispensing guide is rotatable about an axis and said impingement surface comprises an edge of said cover disposed in proximity to said first dispensing guide.

9. The dispensing system of claim 7 wherein said second dispensing guide is disposed on a tray removeably positioned within said interior space.

10. The dispensing system of claim 9 wherein said first and second dispensing guides are each rotatable about a longitudinally extending axis.

11. A dispensing system for premoistened wipes, said system comprising:

a first longitudinally extending dispensing guide having a first longitudinal axis;

a second longitudinally extending dispensing guide having a second longitudinal axis and positioned substantially parallel and in proximity to said first dispensing guide to thereby define a gap between said first and second dispensing guides, the premoistened wipes being dispensed by passage through said gap and a dispensing opening; and an impingement surface, said impingement surface defining an edge of said dispensing opening, said impingement surface having a first outer portion, a second outer portion, and a central portion, said central portion disposed between said first and second outer portions, said central portion disposed relative to said outer portions whereby said central portion and said outer portions are disposed on opposite sides of a flat plane, said flat plane intersecting said gap and being oriented perpendicularly to a second plane connecting said first and second axes and wherein said flat plane lies within said opening adjacent said central portion.

12. The dispensing system of claim 11 wherein said first and second dispensing guides each comprises a rotatable cylinder having a plurality of lands and grooves.

13. The dispensing system of claim 12 wherein an average longitudinal length of said lands and grooves is greater adjacent said central portion than adjacent said outer portions.

14. The dispensing system of claim 11 wherein said central portion has a substantially curvilinear shape.

15. The dispensing system of claim 11 further comprising a cover and a housing, said housing defining an interior space, the premoistened wipes being positionable within said interior space, said cover having an open position permitting access to said interior space and a closed position, said first and second dispensing guides being positioned to form said gap when said cover is in said closed position, and said impingement surface being disposed on said cover.

16. The dispensing system of claim 11 further comprising a housing and a cover, said housing defining an interior space, the premoistened wipes being positionable within said interior space, said cover having an open position permitting access to said interior space and a closed position, said first and second dispensing guides being rotatable and positioned to form said gap when said cover is in said closed position, and said first dispensing guide being disposed on said cover.

17. The dispensing system of claim 16 wherein said impingement surface comprises an edge of said cover.

18. The dispensing system of claim 16 wherein said second dispensing guide is disposed on a tray removeably positioned within said interior space.

19. A method of dispensing premoistened wipes, said method comprising:

providing a plurality of premoistened wipes, each of said wipes having a first side edge and a second side edge;

forming a gap between a first longitudinally extending dispensing guide and a second longitudinally extending dispensing guide;

placing a leading wipe in said gap in a substantially flat configuration whereby said first and second side edges of said leading wipe are disposed on opposite sides of said gap and a forward edge of said leading wipe extends through said gap;

dispensing the premoistened wipes by passage through said gap and a dispensing opening; and engaging an impingement surface which defines an edge of said opening with said leading wipe, said impingement surface having a first outer portion, a second outer portion, and a central portion, said central portion disposed between said first and second outer portions, said impingement surface being configured whereby said outer portions extend a greater distance than said central portion in a direction impinging on said leading wipe and whereby said first and second outer portions respectively engage said leading wipe in first and second areas proximate said first and second side edges wherein said first dispensing guide has a first longitudinally extending axis and said second dispensing guide has a second longitudinally extending axis and said impingement surface has a configuration whereby said central portion is disposed relative to said outer portions when said leading wipe is engaged in said opening whereby said central portion and said outer portions are disposed on opposite sides of a flat plane intersecting said gap and oriented perpendicularly to a plane connecting said first and second axes and wherein said flat plane lies within the dispensing opening adjacent said central portion.

20. The method of claim 19 wherein said gap is formed with rotatable first and second dispensing guides.

21. The method of claim 20 wherein said first and second dispensing guides comprise cylinders having a plurality of lands and grooves and an average longitudinal length of said lands and grooves is greater adjacent said central portion than adjacent said outer portions.

22. The method of claim 19 wherein said plurality of premoistened wipes are provided in a housing having a cover having an open and closed position, said first dispensing guide being disposed on said cover, and wherein said gap is formed by placing said cover in said closed position.

23. The method of claim 22 wherein said second dispensing guide is disposed on a tray removeably positioned in said housing.

24. The method of claim 22 wherein said first and second dispensing guides are rotatable and said impingement surface is disposed on said cover.

25. The method of claim 19 wherein said impingement surface has a configuration whereby a flat plane intersecting said gap and extending through said opening will contact said first and second outer portions prior to contacting said central portion when rotated about a line of intersection with said gap towards said impingement surface.

26. The method of claim 19 wherein said plurality of wipes comprises a coreless roll of premoistened wipes.

27. The method of claim 19 wherein said first and second dispensing guides each comprise a rotatable cylinder having a plurality of lands and grooves.

28. A method of dispensing premoistened wipes, said method comprising:

providing a plurality of premoistened wipes, each of said wipes having a first side edge and a second side edge;

forming a gap between a first longitudinally extending dispensing guide and a second longitudinally extending dispensing guide;

placing a leading wipe in said gap in a substantially flat configuration whereby said first and second side edges of said leading wipe are disposed on opposite sides of said gap and a forward edge of said leading wipe extends through said gap;

rotating at least one of the dispensing guides; and engaging an impingement surface which defines an edge of said opening with said leading wipe, said impingement surface having a first outer portion, a second outer portion, and a central portion, said central portion disposed between said first and second outer portions, said impingement surface being configured whereby said outer portions extend a greater distance than said central portion in a direction impinging on said leading wipe and whereby said first and second outer portions respectively engage said leading wipe in first and second areas proximate said first and second side edges.

29. A dispensing system for premoistened wipes, said system comprising:

a first longitudinally extending dispensing guide;

a second longitudinally extending dispensing guide positionable substantially parallel and in proximity to said first guide to thereby define a gap between said first and second dispensing guides, the premoistened wipes being dispensed by passage through said gap and a dispenser opening;

an impingement surface, said impingement surface defining an edge of said dispensing opening, said impingement surface having a first outer portion, a second outer portion, and a central portion, said central portion disposed between said first and second outer portions, said central portion disposed relative to said outer portions whereby a flat plane intersecting said gap and extending through said opening will contact said first and second outer portions prior to contacting said central portion when rotated about a line of intersection with said gap towards said impingement surface; and a housing and a cover, said housing defining an interior space, the premoistened wipes being positionable within said interior space, said cover having an open position permitting access to said interior space and a closed position, said first and second dispensing guides being positioned to form said gap when said cover is in said closed position, and said first dispensing guide being disposed on said cover wherein said first dispensing guide is rotatable about an axis and said impingement surface comprises an edge of said cover disposed in proximity to said first dispensing guide.

30. A dispensing system for premoistened wipes, said system comprising:

a first longitudinally extending dispensing guide;

a second longitudinally extending dispensing guide positionable substantially parallel and in proximity to said first guide to thereby define a gap between said first and second dispensing guides, the premoistened wipes being dispensed by passage through said gap and a dispenser opening;

an impingement surface, said impingement surface defining an edge of said dispensing opening, said impingement surface having a first outer portion, a second outer portion, and a central portion, said central portion disposed between said first and second outer portions, said central portion disposed relative to said outer portions whereby a flat plane intersecting said gap and extending through said opening will contact said first and second outer portions prior to contacting said central portion when rotated about a line of intersection with said gap towards said impingement surface; and a housing and a cover, said housing defining an interior space, the premoistened wipes being positionable within said interior space, said cover having an open position permitting access to said interior space and a closed position, said first and second dispensing guides being positioned to form said gap when said cover is in said closed position, and said first dispensing guide being disposed on said cover wherein said second dispensing guide is disposed on a tray removeably positioned within said interior space.

* * * * *